US010844684B2

(12) United States Patent
Eitschberger

(10) Patent No.: US 10,844,684 B2
(45) Date of Patent: Nov. 24, 2020

(54) DELIVERY SYSTEM

(71) Applicant: DynaEnergetics Europe GmbH, Troisdorf (DE)

(72) Inventor: Christian Eitschberger, Munich (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 16/788,107

(22) Filed: Feb. 11, 2020

(65) Prior Publication Data

US 2020/0190932 A1 Jun. 18, 2020

Related U.S. Application Data

(63) Continuation of application No. 16/423,230, filed on May 28, 2019, now Pat. No. 10,605,037.

(60) Provisional application No. 62/841,382, filed on May 1, 2019, provisional application No. 62/678,654, filed on May 31, 2018.

(51) Int. Cl.
*E21B 33/068* (2006.01)
*E21B 23/08* (2006.01)

(52) U.S. Cl.
CPC ..... *E21B 33/068* (2013.01); *E21B 23/08* (2013.01)

(58) Field of Classification Search
CPC ..... E21B 33/068; E21B 19/14; E21B 23/08; E21B 44/00; E21B 44/02
See application file for complete search history.

(56) References Cited

U.S. PATENT DOCUMENTS 2,713,909 A * 7/1955 Baker ..... E21B 33/05 166/70
6,182,765 B1 * 2/2001 Kilgore ..... E21B 23/00 166/381
6,454,011 B1 * 9/2002 Schempf ..... E21B 4/18 166/381

(Continued)

FOREIGN PATENT DOCUMENTS

CA 2833722 A1 * 5/2014 ..... E21B 19/00
CA 2833722 A1 5/2014

(Continued)

OTHER PUBLICATIONS

United States Patent and Trademark Office, Final Office Action of U.S. Appl. No. 16/423,230, which is in the same family as U.S. Appl. No. 16/788,107, dated Nov. 4, 2019, 14 pgs.

(Continued)

*Primary Examiner* — Jennifer H Gay
(74) *Attorney, Agent, or Firm* — Moyles IP, LLC

(57) ABSTRACT

A drone conveyance system for deploying drones into an oil or gas wellbore is described. The system includes a platform, a drone magazine, a platform receiver, a conveyance, and a wellhead receiver. A drone magazine contains a plurality of the drones and selectively releases/feeds the drones into the platform receiver. More than one drone magazine, each containing different drone types, may supply drones to the platform receiver such that different drones may be ordered for disposal into the wellbore. The platform receiver prepared the drones to be moved from the platform to the wellhead by the conveyance. The wellhead receiver accepts the drones from the conveyance and prepares each received drone for dropping into the wellbore via the wellhead.

17 Claims, 17 Drawing Sheets

(56) References Cited

U.S. PATENT DOCUMENTS 6,457,526 B1 * 10/2002 Dailey ..... E21B 7/124 166/338
6,474,931 B1 11/2002 Austin et al.
6,488,093 B2 * 12/2002 Moss ..... E21B 19/22 166/339
6,659,180 B2 12/2003 Moss
6,808,021 B2 * 10/2004 Zimmerman ..... E21B 47/0001 166/381
7,018,164 B2 3/2006 Anthis et al.
7,036,598 B2 * 5/2006 Skjærseth ..... E21B 7/124 166/339
7,140,453 B2 * 11/2006 Ayling ..... E21B 19/15 175/52
7,234,525 B2 * 6/2007 Alves ..... E21B 33/068 166/310
7,240,742 B2 7/2007 Sewell et al.
7,331,394 B2 2/2008 Edwards et al.
7,631,704 B2 * 12/2009 Hagemeyer ..... E21B 19/18 166/379
8,006,765 B2 * 8/2011 Richards ..... E21B 7/124 166/351
8,136,585 B2 * 3/2012 Cherewyk ..... E21B 33/068 137/268
8,317,448 B2 * 11/2012 Hankins ..... E21B 19/14 414/22.68
8,899,322 B2 12/2014 Cresswell et al.
8,950,480 B1 2/2015 Strickland
9,617,829 B2 4/2017 Dale et al.
9,797,238 B2 10/2017 Frosell et al.
9,903,192 B2 2/2018 Entchev et al.
10,246,952 B2 * 4/2019 Trydal ..... E21B 19/14
10,323,484 B2 * 6/2019 Liess ..... E21B 41/00
10,358,880 B2 * 7/2019 Metcalf ..... E21B 19/08
2002/0036101 A1 * 3/2002 Huhdanmaki ..... E21B 21/015 175/52
2002/0040783 A1 * 4/2002 Zimmerman ..... E21B 33/076 166/366
2002/0129941 A1 * 9/2002 Alves ..... E21B 33/068 166/310
2002/0134552 A1 * 9/2002 Moss ..... E21B 19/22 166/339
2004/0094305 A1 * 5/2004 Skjærseth ..... E21B 7/124 166/339
2005/0011645 A1 1/2005 Aronstam et al.
2005/0103526 A1 * 5/2005 Ayling ..... E21B 19/15 175/52
2005/0217844 A1 * 10/2005 Edwards ..... E21B 7/124 166/85.1
2006/0054326 A1 * 3/2006 Alves ..... E21B 33/068 166/310
2008/0223587 A1 * 9/2008 Cherewyk ..... E21B 33/068 166/386
2009/0211760 A1 * 8/2009 Richards ..... E21B 7/124 166/339
2009/0255728 A1 * 10/2009 Spencer ..... E21B 7/124 175/5
2010/0288496 A1 * 11/2010 Cherewyk ..... E21B 33/068 166/284
2011/0005777 A1 1/2011 Meff
2013/0062055 A1 * 3/2013 Tolman ..... E21B 47/09 166/250.01
2013/0228326 A1 9/2013 Griffith et al.
2014/0083774 A1 * 3/2014 Hoult ..... E21B 15/003 175/52
2014/0131035 A1 * 5/2014 Entchev ..... E21B 43/263 166/255.1
2014/0360720 A1 12/2014 Corbeil
2015/0114626 A1 4/2015 Hatten et al.
2015/0167410 A1 * 6/2015 Garber ..... F16F 15/06 29/407.02
2015/0209954 A1 * 7/2015 Hokanson ..... B25H 3/003 52/741.14
2016/0115741 A1 * 4/2016 Davis ..... E21B 15/003 414/800
2016/0215592 A1 * 7/2016 Helms ..... E21B 19/16
2017/0044875 A1 * 2/2017 Hebebrand ..... E21B 17/006
2017/0067303 A1 * 3/2017 Thiemann ..... E21B 3/02
2017/0067320 A1 * 3/2017 Zouhair ..... E21B 41/00
2017/0159379 A1 * 6/2017 Metcalf ..... E21B 7/02
2017/0175488 A1 * 6/2017 Lisowski ..... E21B 34/14
2017/0204687 A1 * 7/2017 Yorga ..... E21B 19/14
2017/0306710 A1 * 10/2017 Trydal ..... E21B 19/14
2017/0314372 A1 * 11/2017 Tolman ..... E21B 33/134
2018/0002999 A1 1/2018 Johnson
2018/0003038 A1 1/2018 Cherewyk
2018/0313182 A1 * 11/2018 Cherewyk ..... E21B 33/068
2018/0355674 A1 * 12/2018 Cooper ..... E21B 15/02
2019/0031307 A1 * 1/2019 Siersdorfer ..... E21B 41/0007
2019/0186211 A1 * 6/2019 Gonzalez Gonzalez ..... E21C 41/26
2019/0218880 A1 * 7/2019 Cannon ..... E21B 33/068
2019/0316449 A1 * 10/2019 Schultz ..... E21B 33/13
2019/0338606 A1 * 11/2019 Metcalf ..... E21B 19/08
2019/0368301 A1 * 12/2019 Eitschberger ..... E21B 33/068

FOREIGN PATENT DOCUMENTS

CN 201546707 U 8/2010
CN 204430910 U 7/2015
DE 10341437 A1 4/2005
DE 10344523 A1 * 4/2005 ..... E21B 19/20
EP 2310616 B1 4/2011
WO 0133029 A2 5/2001
WO 0133029 A3 12/2001
WO 2015081092 A2 6/2015
WO 2018094220 A1 5/2018

OTHER PUBLICATIONS

United States Patent and Trademark Office, Non-Final Office Action of U.S. Appl. No. 16/423,230, which is in the same family as U.S. Appl. No. 16/788,107, dated Aug. 27, 2019, 16 pgs.
International Searchiing Authority, International Search Report and Written Opinion of International App. No. PCT/EP2019/063966, which is in the same family as U.S. Appl. No. 16/788,107, dated Aug. 30, 2019, 10 pages.
United States Patent and Trademark Office, Final Office Action of U.S. Appl. No. 16/542,890, dated May 12, 2020, 16 pgs.

* cited by examiner

DELIVERY SYSTEM

CROSS-REFERENCE TO RELATED APPLICATIONS

This application is a continuation of U.S. application Ser. No. 16/423,230 filed May 28, 2019, which claims the benefit of U.S. Provisional Patent Application No. 62/841,382, filed May 1, 2019 and U.S. Provisional Patent Application No. 62/678,654, filed May 31, 2018, each of which is incorporated herein by reference in its entirety.

BACKGROUND OF THE DISCLOSURE

Oil and gas reserves are accessed using various drilling and completion techniques. The drilling techniques require preparation of a drilling site by the formation of a wellbore 50, as illustrated in FIG. 1. A wellbore 50 is a narrow shaft drilled in the ground, vertically and/or horizontally as well as angles therebetween. A wellbore 50 can include a substantially vertical portion and a substantially horizontal portion and a typical wellbore 50 may be over a mile in depth, the vertical portion, and several miles in length, the horizontal portion.

A wireline, electric line or e-line 24 is cabling technology used to lower and retrieve equipment or measurement devices into and out of the wellbore 50 of the oil or gas well for the purpose of delivering an explosive charge, evaluation of the wellbore 50 or other completion-related tasks. The equipment/devices deployed in the wellbore 50 are often generically referred to as downhole tools 20 and examples of such tools are perforating guns, puncher guns, logging tools, jet cutters, plugs, frac plugs, bridge plugs, setting tools, self-setting bridge plugs, self-setting frac plugs, mapping/positioning/orientating tools, bailer/dump bailer tools and ballistic tools. Such downhole tools 20 are typically attached to a wireline 24 (i.e., an electric cable or eline), fed through or run inside the casing or tubing, and are lowered into the wellbore 50. Other methods include tubing conveyed (i.e., TCP for perforating) or coil tubing conveyance. A speed of unwinding a wireline cable 24 and winding the wireline cable 24 back up is limited based on a speed of the wireline equipment 26 and forces on the wireline cable 24 itself (e.g., friction within the well). Because of these limitations, it typically can take several hours for a wireline cable 24 and tool-string 22 to be lowered into a well and another several hours for the wireline cable 24 to be wound back up and the expended toolstring 22 retrieved. When detonating explosives, the wireline cable 24 will be used to position a downhole tool 20 or toolstring 22 into the wellbore 50 as well as provide power and/or communication to said tool string.

This type of deployment process requires the selection of a downhole tool 20, the attachment of that downhole tool 20 or a combination of tools to the wireline 24, and in some instances, the removal of the downhole tool(s) 20 from the wellbore 50. When an operator needs to deploy additional downhole tools 20 into the wellbore 50, which may be the same as or different from previously-deployed tool(s), the operator must first retract/retrieve the wireline 24 from the wellbore 50 and then attach the wireline 24 to the additional downhole tool(s) 20. That is, no practical means exists for deploying more than one wireline 24 into a wellbore 50 during typical operations. This completion process requires multiple steps, a significant array of equipment, and can be time consuming and costly. Furthermore, equipment lodged in the wellbore will typically result in complication, delay, additional human resource time, equipment cost and, often, exorbitant expense to operations.

The various drilling and completion operations requiring deployment of various downhole tools 20 as well as the changing of tools being deployed, currently require direct human interaction with the wireline 24, the tools 20 on the wireline 24 and the feeding of tools/wireline into the equipment attached to the wellhead 30. Wellhead 30 is a general term used to describe the pressure-containing component at the surface of an oil well that provides the interface for drilling, completion, and testing of all subsurface operation phases. Being pressurized and the pressurization subject to an unknown level of variability, in addition to the substantial amount of shifting equipment adjacent the wellhead 30, the area around the wellhead 30 is referred to as a 'red zone'. That is, the dangers inherent in drilling and completion operations are focused in the area within a few yards or tens of yards around the wellhead 30. During operations, only trained personnel are permitted within a certain distance of the wellhead 30 and those personnel must be properly protected. Even then, the activities of attaching and detaching tools 20 from a wireline 24, deploying a wireline 24 and attached toolstring 22 into a wellbore 50 and retrieving a wireline 24 and attached toolstring 22 from a wellbore 50, are inherently difficult, dirty and dangerous.

In view of the disadvantages associated with currently available devices and methods for well completion, there is a need for a device and method that increases the efficiency of the completion processes. There is a further need for a device and method that increases safety, reduces the steps, time to achieve steps, time between steps and associated costs and equipment for well completion processes. There is a further need for a system and method that reduces the delay between drilling of a wellbore and production of oil or gas from the wellbore. In light of the dangers of deploying and retrieving tools from a wellbore, there is also a need to reduce or eliminate the number of persons in the red zone adjacent the wellhead, especially during particularly risk prone activities.

SUMMARY DESCRIPTION OF THE EXEMPLARY EMBODIMENTS

This disclosure generally describes deployment systems for devices/downhole tools. The devices may include a drone configured to perform one or more functions downhole. According to an aspect, the drone is a fluid or flow-rate-propelled tool. In an embodiment, a drone delivery apparatus for conveying a drone into a wellbore includes a drone magazine configured to contain a plurality of drones and a drone conveyance. The drone conveyance has a conveyance entrance located proximate the drone magazine and configured to receive the drones from the drone magazine and a conveyance exit. The conveyance entrance and the conveyance exit are connected to a wellhead and configured to orientate the drone for deposit into the wellbore. In addition, the drone conveyance is configured to move the drone from the conveyance entrance to the conveyance exit.

The drone delivery apparatus may also have a platform configured to support the drone magazine, the platform may include a platform receiver connected to the conveyance entrance and configured to receive the drone from the drone magazine and prepare the drone for the deposit into the conveyance entrance. The platform receiver may also include a lower receiving chamber configured to receive the drone from the drone magazine and an upper receiving chamber connected to the lower receiving chamber and the conveyance entrance, the upper receiving chamber configured to prepare the drone for the deposit into the conveyance entrance and the movement from the conveyance entrance to the conveyance exit.

The drone conveyance may have an elongate chamber extending from the conveyance entrance to the conveyance exit, the elongate chamber sized to fit the drones. The platform receiver and a wellhead receiver may be configured to seal and maintain a set of conditions in the elongate chamber different from a set of conditions outside the elongate chamber, e.g., the set of conditions in the elongate chamber may be those of a pressurized fluid. The upper receiving chamber may be configured to expose the drone to the set of conditions in the elongate chamber. The wellhead receiver may be configured to receive the drone from conveyance exit and prepare the drone for the deposit into the wellhead, the drone may be received under the set of conditions in the elongate chamber.

The drone delivery apparatus may also include a launcher valve disposed between the wellhead receiver and the wellhead and a wellhead receiver valve disposed between the conveyance exit and the wellhead receiver. The wellhead receiver valve may be configured to seal the wellhead receiver from the conditions in the elongate chamber. In addition, the wellhead and wellbore may define a set of conditions and the launcher valve being configured to seal the set of wellbore conditions from the wellhead receiver while the launcher valve is also configured to expose the drone to the set of wellbore conditions.

The drone delivery apparatus that includes a drone magazine may include a magazine frame configured to contain a plurality of drones and also configured to permit movement of the drone within and from the magazine toward the conveyance entrance. In an embodiment, a drone delivery apparatus may include a first group of one or more drones arranged in a first section of the magazine frame and a second group of one or more drones arranged in a second section of the magazine frame. The magazine may be configured to permit movement of the drones from either the first group or the second group and may permit alternating movement of the drones from the first group or the second group.

In an embodiment, a method for delivery of a drone into a wellbore includes the steps of attaching a drone magazine containing a plurality of drones to a drone conveyance that includes a conveyance entrance and a conveyance exit; moving the drone from the drone magazine into the drone conveyance through the conveyance entrance; transporting the drone from adjacent the conveyance entrance to adjacent the conveyance exit and dropping the drone into the wellbore. The drone delivery method may also include one or more of the steps of supporting the drone magazine on a platform, inserting the drone into a platform receiver, preparing the drone for introduction into the conveyance and moving the drone from the conveyance entrance to the conveyance exit.

The drone delivery method may also include the steps of providing the platform receiver with a lower receiving chamber configured to receive the drone from the drone magazine; receiving the drone from the drone magazine into the lower receiving chamber; connecting the upper receiving chamber to the lower receiving chamber; moving the drone from the lower receiving chamber to the upper receiving chamber; connecting the upper receiving chamber to the conveyance entrance and moving the drone to the conveyance entrance, through the conveyance to the conveyance exit.

The drone conveyance of the drone delivery method may have an elongate chamber extending from the conveyance entrance to the conveyance exit. The elongate chamber may be sized to fit a drone. The method may also include sealing the elongate chamber of the drone conveyance and maintaining a set of conditions in the elongate chamber different from a set of conditions outside the elongate chamber where the set of conditions in the elongate chamber may be configured to achieve the step of transporting the drone from adjacent the conveyance entrance to adjacent the conveyance exit. The set of conditions in the elongate chamber may be those of a pressurized fluid. Adapting the upper receiving chamber to the set of conditions in the elongate chamber so as to expose the drone to the set of conditions in the elongate chamber may be an additional step achieved by the method.

The drone delivery method may also be performed where the magazine comprises a magazine frame configured to contain a plurality of drones and include the step of selecting the drone from the magazine to be moved in the moving step. A first group of one or more drones may occupy a first section of the magazine frame and a second group of one or more drones may occupy a second section of magazine frame. In such an embodiment, the selecting step includes determining which of either the first group or the second group of drones will be selected. Also, the step of selecting the first group or the second group of drones may include alternating between the first group and the second group. Any of the steps may be accomplished automatically. The method may also include the step of attaching one or more an additional drone magazine to the drone conveyance.

In an embodiment, the drone delivery method may include the steps of testing the drone, displacing a rejected drone into a rejection chamber connected to the drone conveyance and/or moving the rejected drone from the rejection chamber into a rejection magazine.

The drone delivery method may also include the steps of detaching the drone magazine from the drone conveyance; attaching a drop ball magazine containing one or more drop balls to the drone conveyance, moving the drop ball from the drop ball magazine into the drone conveyance and dropping the drop ball into the wellbore.

The drone delivery method may be performed where the drone is selected from the group comprising of a perforating gun, puncher gun, logging tool, jet cutter, plug, frac plug, bridge plug, setting tool, self-setting bridge plug, self-setting frac plug, mapping/positioning/orientating tool, bailer/dump bailer tool and ballistic tool. The drone delivery method may also include the step of actuating a drone safety mechanism, e.g., a mechanical latch.

In an embodiment, a drone delivery apparatus for conveying a drone into a wellbore may include a drone magazine configured to contain a plurality of drones; a drone chute including a chute entrance and a chute exit, the chute entrance located proximate the drone magazine and configured to receive the drones from the drone magazine and the chute exit connected to a wellhead and configured to orientate the drone for disposition into the wellbore. The drone chute may be configured to move the drone from the chute entrance to the chute exit. Many of the elements applicable to the drone conveyance are applicable to the drone chute. Further, the methods for delivery of a drone into a wellbore utilizing the drone conveyance are equally applicable when utilizing the drone chute.

According to an embodiment, a drone delivery apparatus for conveying a drone into a wellbore may include a drone magazine configured to contain a plurality of drones and a drone ramp including one or more ramp sleds, a ramp entrance and a ramp exit, the ramp entrance located proximate the drone magazine and configured to permit the ramp sled to receive the drones from the drone magazine and the ramp exit located proximate a wellhead, the ramp, the ramp sled and the ramp exit are configured to orientate and transport the drone for deposit into the wellbore. Further, the ramp sled is configured to allow attachment of the drone to the ramp sled proximate the ramp entrance, movement of the drone from the ramp entrance to the ramp exit and detachment of the drone from the ramp sled proximate the ramp exit.

The drone delivery apparatus may further include a conveyer belt extending along the drone ramp from the ramp entrance to the ramp exit, the conveyer belt having the one or more ramp sleds attached thereto. The conveyer belt is configured to move the drone sled from the ramp entrance to the ramp exit.

The drone delivery apparatus may include a wellhead receiver connected to the wellhead, the wellhead receiver is configured to receive the drone from the ramp exit and prepare the drone for introduction into the wellbore through the wellhead. The wellhead receiver may be configured to detach the drone from the ramp sled.

In an embodiment, the drone delivery apparatus may include a launcher valve disposed between the wellhead receiver and the wellhead and a wellhead receiver valve on the wellhead receiver proximate the ramp exit. The wellhead receiver valve may be configured to seal the wellhead receiver. The launcher valve may be configured to prevent fluid communication between the wellbore and the wellhead receiver. In addition, the launcher valve may also be configured to permit fluid communication between the wellbore and the wellhead receiver in order to expose the drone to the fluid pressure in the wellbore. The wellhead receiver may also be configured to receive the drone and expose the drone to the fluid pressure of the wellbore.

A magazine, magazine frame and one or more groups of drones may have a similar relationship to the ramp/conveyor drone delivery apparatus as the conveyance and/or chute drone delivery apparatus. Similarly, methods for delivery of a drone utilizing a drone ramp will be analogous to the methods for delivery for the conveyance and/or chute drone methods.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
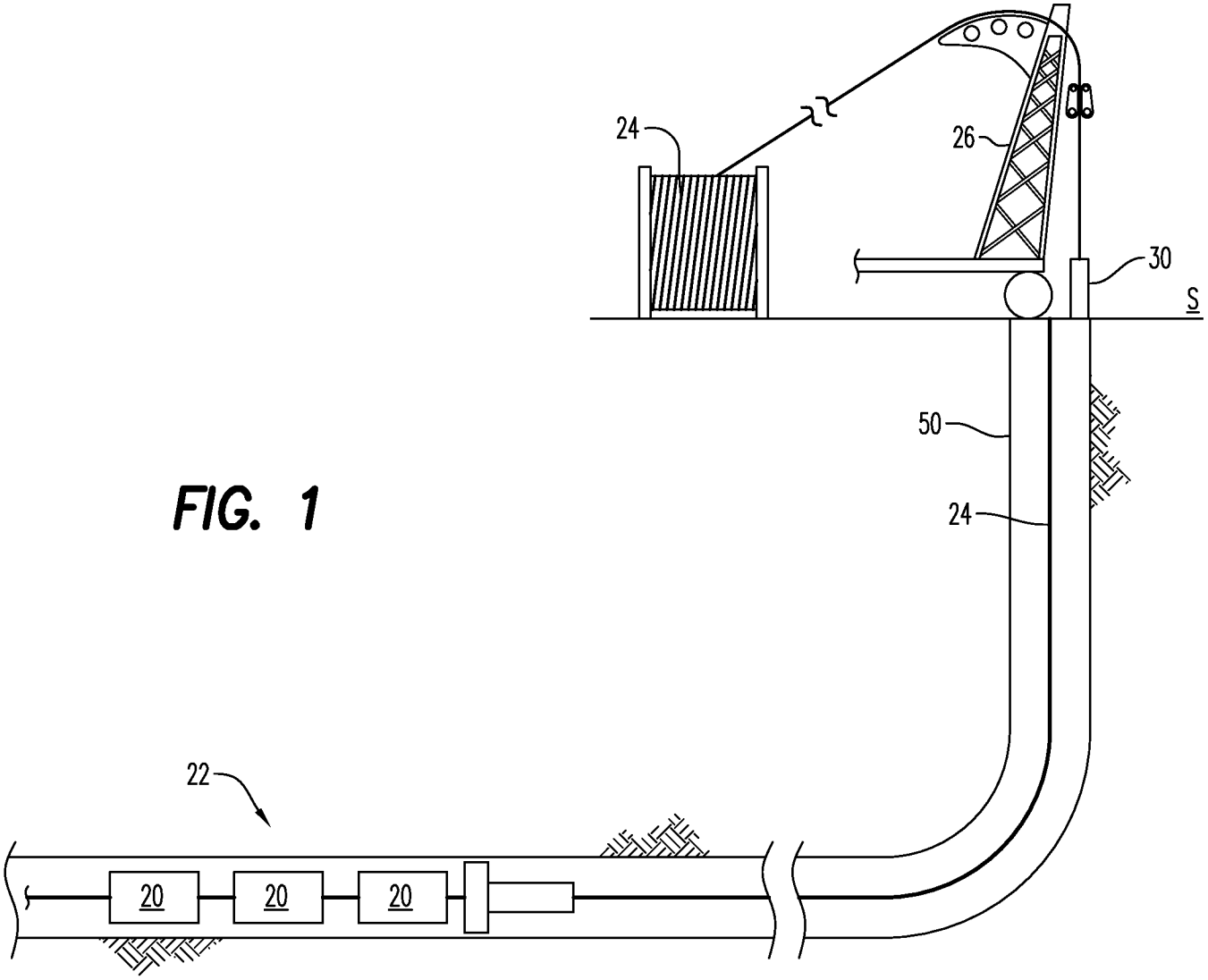
FIG. 1 is a side, plan view of a prior art system for deploying downhole tools in a wellbore by wireline.

Various features, aspects, and advantages of the embodiments will become more apparent from the following detailed description, along with the accompanying figures in which like numerals represent like components throughout the figures and text. The various described features are not necessarily drawn to scale but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

For purposes of illustrating features of the embodiments, embodiments of the disclosure will now be introduced in reference to the figures. Those skilled in the art will recognize that these examples are illustrative and not limiting and are provided purely for explanatory purposes.

This application incorporates by reference each of the following pending patent applications in their entireties: U.S. Provisional Patent Application No. 62/842,329, filed May 2, 2019; U.S. Provisional Patent Application No. 62/841,382, filed May 1, 2019; International Patent Application No. PCT/US2019/27383, filed Apr. 12, 2019; U.S. Provisional Patent Application No. 62/831,215, filed Apr. 9, 2019; International Patent Application No. PCT/US2019/25024, filed Mar. 29, 2019; U.S. Provisional Patent Application No. 62/832,737, filed Mar. 26, 2019; International Patent Application No. PCT/US2019/22799, filed Mar. 18, 2019; U.S. Provisional Patent Application No. 62/816,649, filed Mar. 11, 2019; U.S. Provisional Patent Application No. 62/720,638, filed Aug. 21, 2018; U.S. Provisional Patent Application No. 62/765,185, filed Aug. 16, 2016; U.S. Provisional Patent Application No. 62/719,816, filed Aug. 20, 2018; U.S. Provisional Patent Application No. 62/690,314, filed Jun. 26, 2018; U.S. Provisional Patent Application No. 62/678,654, filed May 31, 2018; and U.S. Provisional Patent Application No. 62/678,636, filed May 31, 2018.

In general, the embodiments of the disclosure concern the use of one or more drones 10 in well completion operations. An untethered drone refers to a downhole tool not connected to a physical wire/cable. Drones, whether tethered or untethered are configured for deployment into and use in a wellbore. The drone may be configured to move at pump speed or flow rate speed (i.e., the speed at which fluid is pumped into the wellbore). For purposes of this disclosure and without limitation, a "drone" refers generally to an untethered drone, i.e., a drone without a wireline attached. Further, "autonomous" means without a physical connection or manual control and "semi-autonomous" means without a physical connection. As described herein, the drone 10 may be launched into the wellbore 50 and may be autonomous or semi-autonomous.

Figure 2:
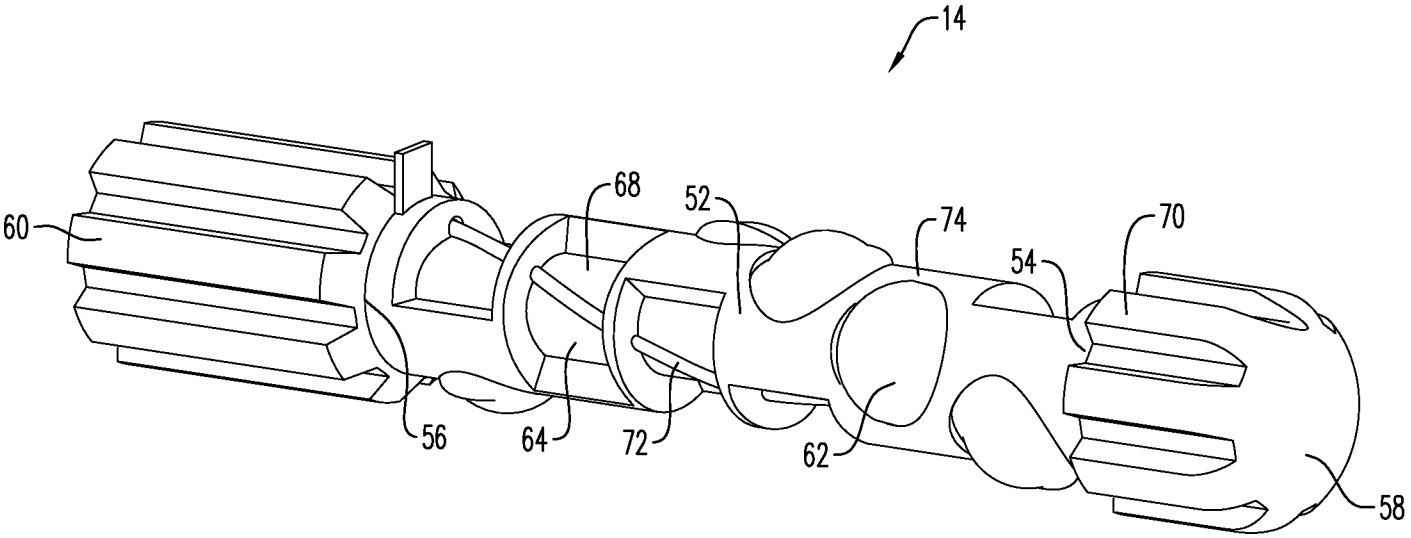
FIG. 2 is a perspective view of a drone.

The wellbore tools incorporated in a drone 10 may include, for example and without limitation, a perforating gun, puncher gun, logging tool, jet cutter, plug, frac plug, bridge plug, setting tool, self-setting bridge plug, self-setting frac plug, mapping/positioning/orientating tool, bailer/dump bailer tool and ballistic tool. The wellbore tool drones may disintegrate or be removed from the wellbore 50 after a downhole wellbore operation. With reference to FIG. 2, an exemplary embodiment of an perforating gun drone 14 is shown, though an drone in accordance herewith may include virtually any type of wellbore tool.

Perforating gun drone 14 includes a body portion 52 having a front end 54 and a rear end 56. A head portion 58 extends from the front end 54 of the body portion 52 and a tail portion 60 extends from the rear end 56 of the body portion 52 in a direction opposite the head portion 58. The body portion 52 includes a plurality of shaped charge apertures 74 and open apertures 64 extending between an external surface 66 of the body portion 52 and an external surface 68 of the open apertures 64. Each of the plurality of shaped charge apertures 74 are configured for receiving and retaining a shaped charge 62. A detonation cord (not shown) is housed in a detonation cord track 72 and brings energy, typically deflagration or detonation energy, to each of the shaped charges 62. As shown in FIG. 2, each of the head portion 58 and the tail portion 60 is substantially cylindrically-shaped and may include fins 70.

In the exemplary disclosed perforating gun drone 14 embodiment, the body portion 52 is a unitary structure that may be formed from an injection-molded material, as are the body portion 52, the head portion 58 and the tail portion 60. In other embodiments, the body portion 52, the head portion 58 and the tail portion 60 may constitute modular components or connections. Each of these features, as well as the generally cylindrical shape of body portion 52, is configured with regard to travel of a drone 10 into and through a wellbore 50.

Figure 3:
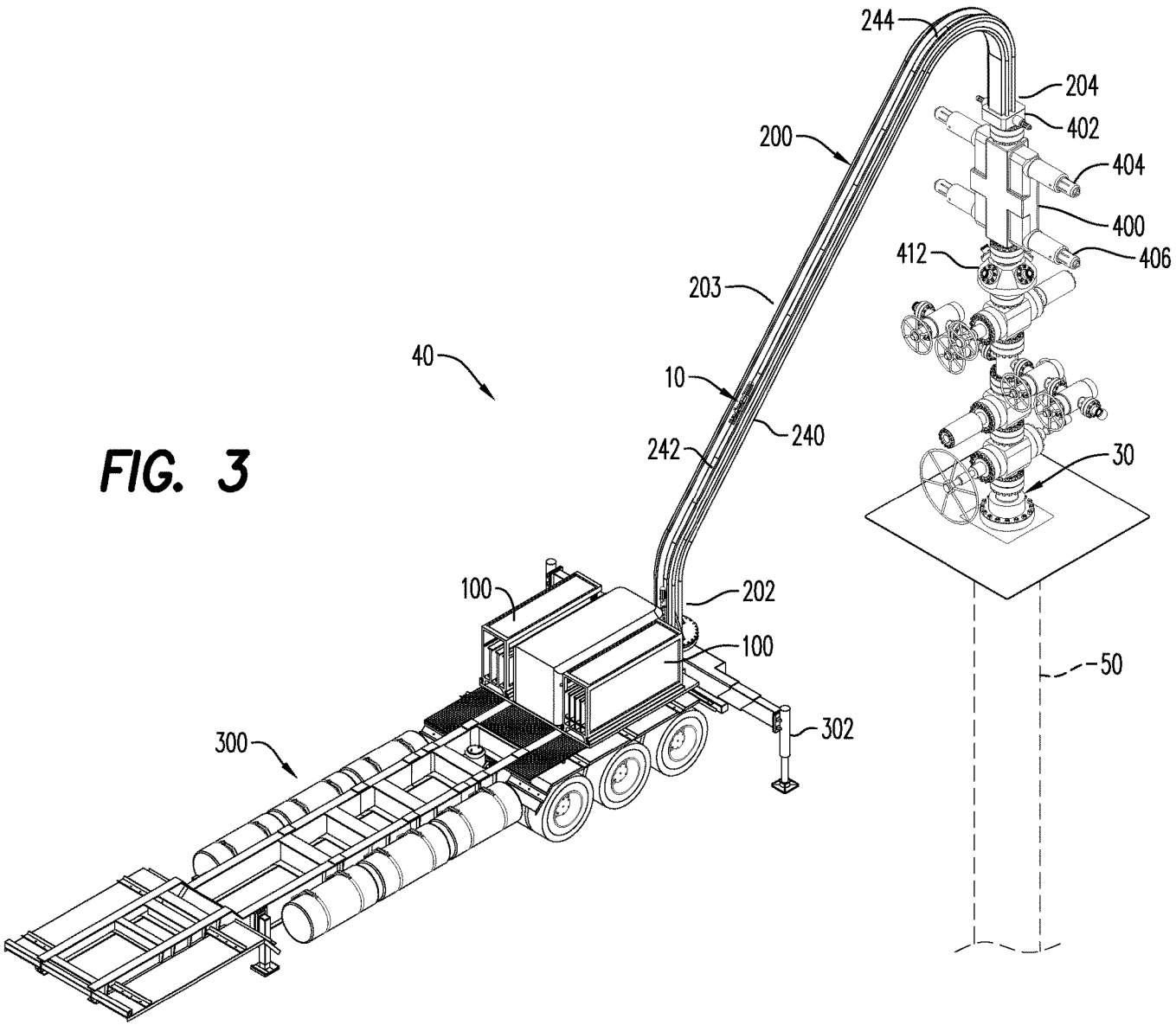
FIG. 3 is a perspective view of a drone conveyance/delivery system according to an embodiment.

Turning now to FIG. 3, an embodiment of a drone conveyance system 40 is illustrated. The function of drone conveyance system 40 is to convey a drone 10 into a wellbore 50. The drone conveyance system 40 may include one or more drone magazines 100 and a drone conveyance 200. The particular drone conveyance system 40 illustrated in FIG. 3 includes a ramp 240, conveyer 244 and plurality of sleds 242 attached to the conveyer 244. Each drone magazine 100 is designed to be loaded with a plurality of drones 10 and multiple drone magazines 100 may be utilized.

The drone conveyance 200 has a conveyance entrance 202, a conveyance exit 204 and a center portion 203 between the conveyance entrance 202 and conveyance exit 204 configured to convey the drone 10 between the entrance 202 and exit 204. The conveyance entrance 202 is located proximate the drone magazine 100 and receives a selected drone 10 from the drone magazine 100. Receipt of the drone 10 from drone magazine 100 is either direct or indirect, as discussed with regard to several embodiments hereinbelow. The conveyance exit 204 is connected to a wellhead 30. The connection between the conveyance exit 204 and wellhead 30 will orientate the drone 10 and otherwise prepare the drone 10 for deposit into the wellbore 50. As further described hereinbelow, this connection includes a wellhead receiver 400, a wellhead receiver valve 402 disposed between the conveyance exit 204 and the wellhead receiver 400, and a launcher valve 412 located between the wellhead receiver 400 and the wellhead 30. Also potentially present on the wellhead receiver 400 and further explained hereinbelow are one or more lubrication inputs 404 and lubrication outputs 406

The drone magazines 100 are typically disposed on a platform 300. In the embodiment illustrated in FIG. 3, the platform 300 is the bed of a semi-truck trailer. Generally, platform 300 may be fixed or mobile and performs the primary function of providing a stable place to put the drone magazines 100 adjacent the conveyance entrance 202.

Figure 4:
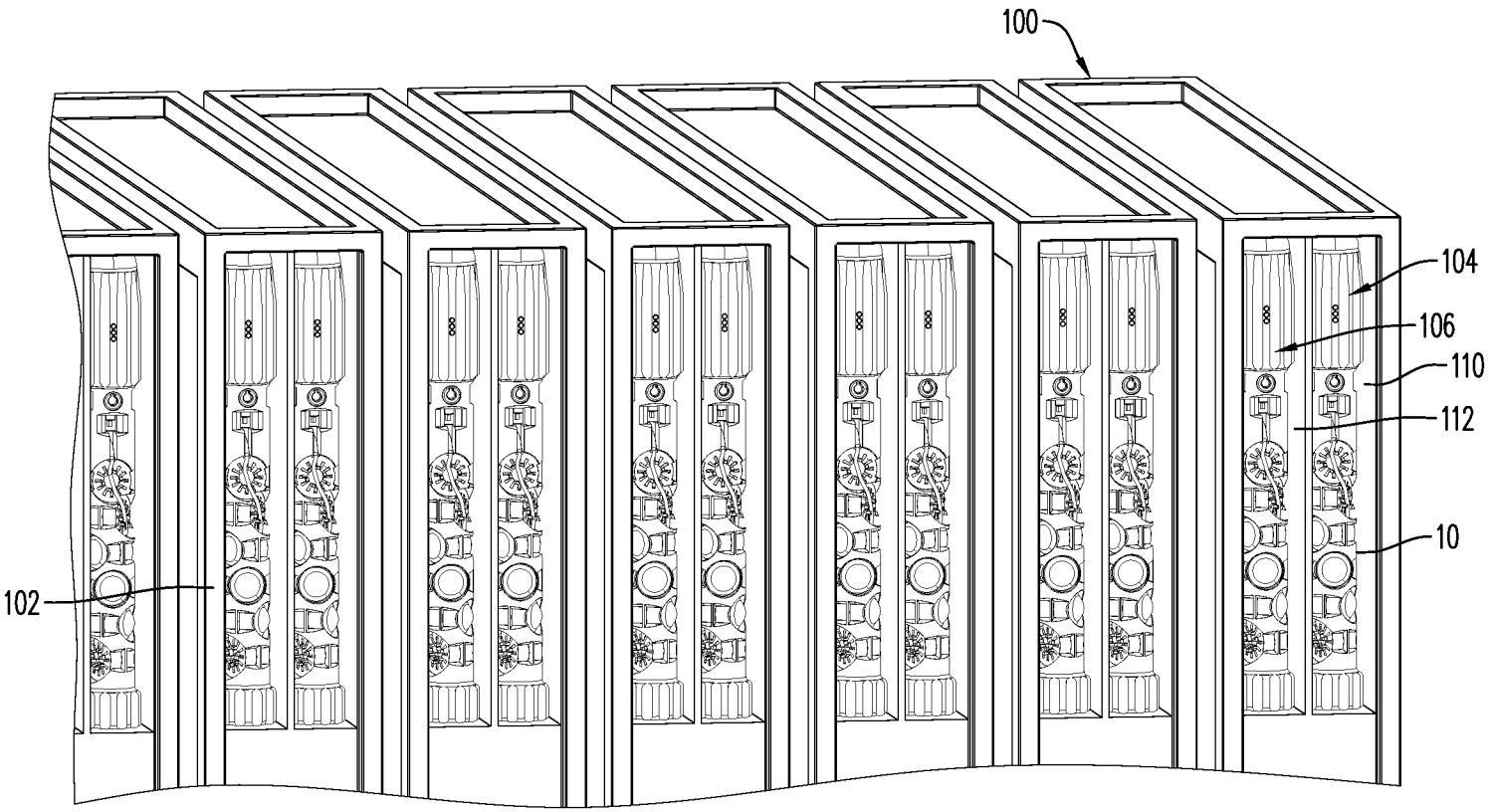
FIG. 4 is perspective view of a plurality of drone magazines, each containing a plurality of drones.

It is contemplated that the drone conveyance system 40 may be used with or without a drone magazine and, if used with a drone magazine, that a large number of potential drone magazine designs exist. In an embodiment illustrated in FIG. 4, an array of essentially identical drone magazines 100 is shown, each magazine 100 containing a plurality of drones 10. The magazine 100 of FIG. 4 includes a magazine frame 102 serving the function of holding the plurality of drones 10. The magazine frame 102, as seen in FIG. 4, may be divided into multiple sections. For example, first section 110 of magazine frame 102 may hold a first group of drones 104 and second section 112 of magazine frame 102 may hold a second group of drones 106. In addition, other multi-segment magazine frames may hold other groups of drones. Each group of drones may, whether occupying a single magazine or multiple magazines, comprise a single tool. That is, tools having different functions may be selected from one or more magazines 100 and dropped into the wellbore 50 in a predetermined and useful order. Alternatively, different groups of drones may be the same tool but with configuration details varying from group to group.

Tools with a particular configuration may be placed in the wellbore 50 in a predetermined and useful order. In another embodiment, a magazine 100 may be loaded with drones 10 of different types or configurations in the order in which it is desired to drop the drones 10 into the wellbore. In this case, switching magazines 100 is unnecessary except to the extent that a magazine 100 has been exhausted of drones 10.

Figure 5:
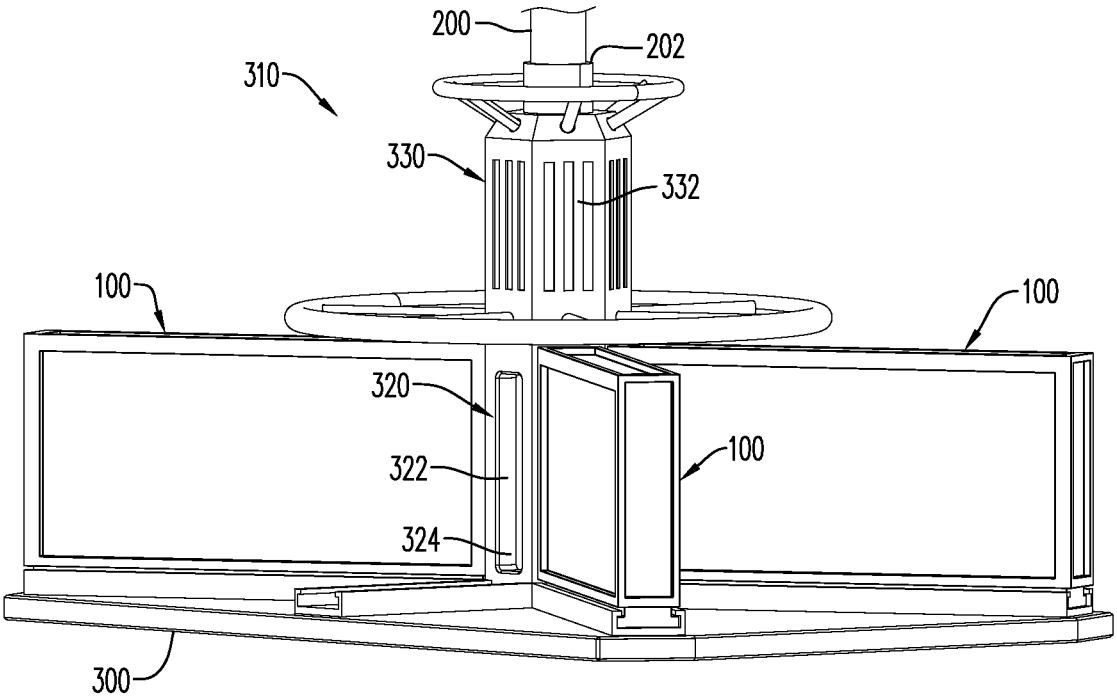
FIG. 5 a perspective view of a platform, platform receiver and plurality of drone magazines attached to the platform receiver.

In an embodiment, illustrated in FIG. 5, a platform receiver 310 is disposed on a platform 300. The platform receiver 310 has a lower receiving section 320 having one or more chamber openings 322. Each chamber opening 322 is sized to permit the insertion of a drone 10 into a lower receiving chamber 324 located inside the lower receiving section 320. A magazine 100 may be connected to or positioned adjacent the lower receiving section 320 at the chamber opening 322. A mechanism associated with either the platform receiver 310 or the magazine 100 will move a drone 10 from the magazine 100, through the chamber opening 322 into the lower receiving chamber 324. For example, a compression spring (not shown) in the magazine may exert a force on the drones 10, pushing them through the chamber opening 322.

In the FIG. 5 embodiment, a plurality of magazines 100 are arranged in a circle around the lower receiving section 320 of the platform receiver 310. In the event that the lower receiving section has a single chamber opening 322, the platform 300 may rotate such that each of the plurality of magazines 100 may be aligned with the chamber opening 322. That is, when it is desired that the next drone 10 to be loaded into lower receiving chamber 324 come from a particular magazine 100, the platform 300 is rotated such that the particular magazine aligns with the chamber opening 322, at which point a drone 10 is moved from the magazine 100 into the lower receiving chamber 324 through the chamber opening 322.

The FIG. 5 embodiment also contemplates a plurality of chamber openings 322, only one of which is shown. The other chamber openings 322 are covered by magazines 100. That is, each magazine 100 engages the lower receiving section 320 at a different chamber opening 322 in the periphery of the lower receiving section 320. In this arrangement, there is no need to rotate the platform 300 and magazines 100. Rather, a mechanism (not shown) internal to the lower receiving section 320 is used to select a particular magazine 100 from which the next drone will be received into the lower receiving chamber 324.

The lower receiving section 320 may, in an embodiment, be connected directly to the conveyance entrance 202. In such an arrangement, the drone 10 is moved from the lower receiving chamber 324 into or onto the conveyance 200 through the conveyance entrance 202. Alternatively, the platform receiver 310 may include an upper receiving section 330, disposed above the lower receiving section 320. The drone 10 in lower receiving chamber 324 is moved into an upper receiving chamber 332 of the upper receiving section 330 prior to being moved into conveyance 200. Movement of the drone 10 from the lower receiving chamber 324 into the conveyance entrance 202 or upper receiving chamber 332 may be accomplished with an actuator, elevator, or the like.

Figure 6:
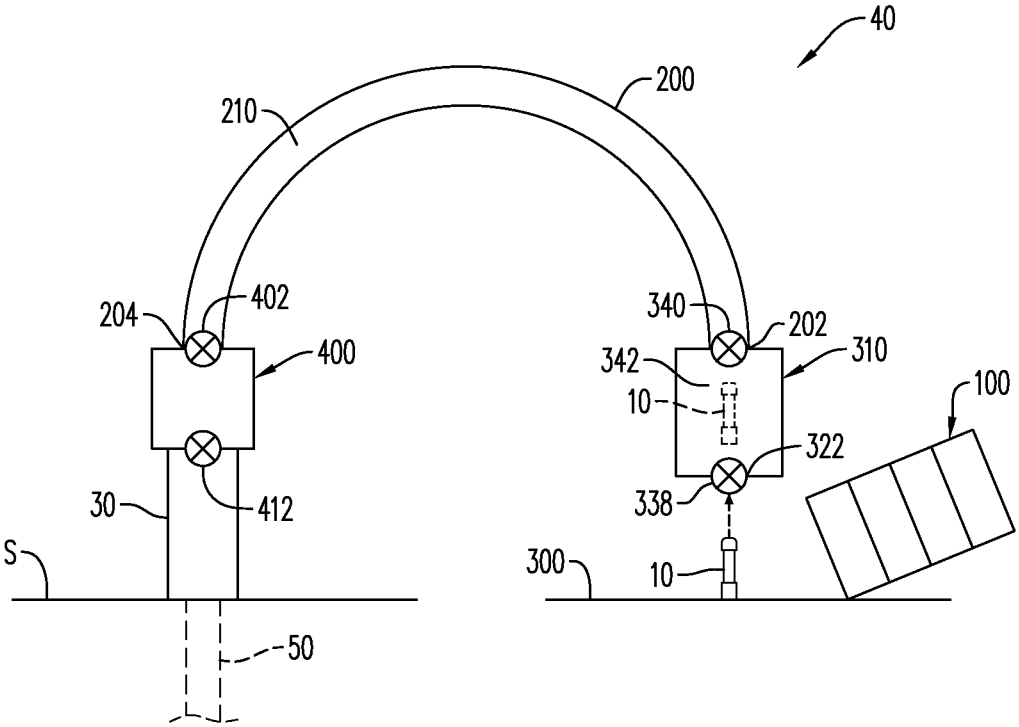
FIG. 6 is a side, plan view of a drone delivery apparatus according to an embodiment.

One purpose of upper receiving section 330 is to make any necessary preparations for the transition of the drone 10 from the conditions in magazine 100 and lower receiving section 320 to the conditions of the conveyance 200. With reference to FIG. 6, conveyance 200 may include an elongate chamber 210 sized to fit the drone 10 and containing a pressurized fluid that enables movement of the drone 10. In such a circumstance, the drone may be prepared for insertion into the elongate chamber 210 by being exposed to the conditions of the elongate chamber while in the upper receiving chamber 332. Valves 338, 340 separating the lower receiving chamber 324 from the upper receiving chamber 332 and the upper receiving chamber 332 from the conveyance entrance 202 may be used to alter the conditions surrounding the drone 10. Thus, after drone 10 is moved from lower receiving chamber 324 into upper receiving chamber 332, the valve 338 may seal the upper receiving chamber from the lower receiving chamber 324. Once sealed, the upper receiving chamber 332 and the drone 10 may be subjected to the conditions of the elongate chamber 210 of the conveyance 200. The conveyance entrance valve 340 may seal the upper receiving chamber 332 from the elongate chamber 210 and be opened to allow the drone 10 to move through the conveyance entrance 202 into the elongate chamber 210.

In the embodiment, illustrated in FIG. 6, the platform receiver 310 is disposed above the platform 300. The platform receiver 310 may be provided with a chamber opening 322 on the underside thereof. The chamber opening 322 is sized to permit the insertion of a drone 10 into a receiving chamber 342 located inside the platform receiver 310. A magazine 100 may be connected to or positioned adjacent the chamber opening 322; the magazine 100 may be supported by the platform 300. In the event a magazine 100 is used, a mechanism associated with either the magazine 100 or the platform 300 will move a drone 10 from the magazine 100, through the chamber opening 322 into the receiving chamber 342. If a magazine is not used, a mechanism associated with the platform 300 moves the drone 10 into the receiving chamber 342 or the drone 10 is manually moved into the receiving chamber. The mechanism that moves the drone 10 into the receiving chamber may be an actuator, lift, or similar device. If necessary, platform receiver valve 338 can close chamber opening 322 so that the receiving chamber 342 and the drone 10 may be subjected to the conditions of the elongate chamber 210 of the conveyance 200. Once the drone 10 is subjected to the conditions of the elongate chamber 210, the conveyance entrance valve 340 used to seal the receiving chamber 342 from the elongate chamber 210 may be opened and the drone 10 moved through the conveyance entrance 202 into the elongate chamber 210.

At the wellhead 30 end of the conveyance 200 and connected to the conveyance exit 204 is a wellhead receiver 400. The wellhead receiver 400 is also connected to the wellhead 30. The wellhead 30 is usually adjacent the surface S of the ground into which the wellbore 50 is formed. The wellhead receiver 400 receives the drone 10 from conveyance exit 204 and prepares the drone 10 for deposit into the wellbore 50 through the wellhead 30. Deposit of the drone 10 into the wellbore 50 may also be referred to as dropping the drone 10 into the wellbore 50. The wellhead receiver 400 receives the drone 10 at whatever the conditions are of the elongate chamber 210. Since it will prepare the drone 10 for deposit into the wellbore 50, an alternative name the wellhead receiver 400 is the "launcher".

Once the drone 10 is in the wellhead receiver 400, the drone 10 is prepared for deposit into the wellbore 50. A wellhead receiver valve 402, disposed between the conveyance exit 204 and the wellhead receiver 400, may be closed so as to seal the wellhead receiver 400 from the conditions in the elongate chamber 210. Subsequent to the wellhead receiver valve 402 being closed, the conditions in the wellhead receiver 400 may be adjusted to those of the wellbore conditions utilizing one or more lubrication inputs 404 and lubrication outputs 406, see FIG. 3. A launcher valve 412 is located between the wellhead receiver 400 and the wellhead 30. The launcher valve 412, when closed, seals the wellhead receiver 400 off from the conditions of the wellbore 50. Once the lubricators 404, 406 have exposed the drone 10 inside the wellhead receiver 400 to the wellbore conditions, the launcher valve 412 may be opened and the drone 10 dropped through the wellhead 30 and into the wellbore 50, which extends under the surface "S".

Figure 7:
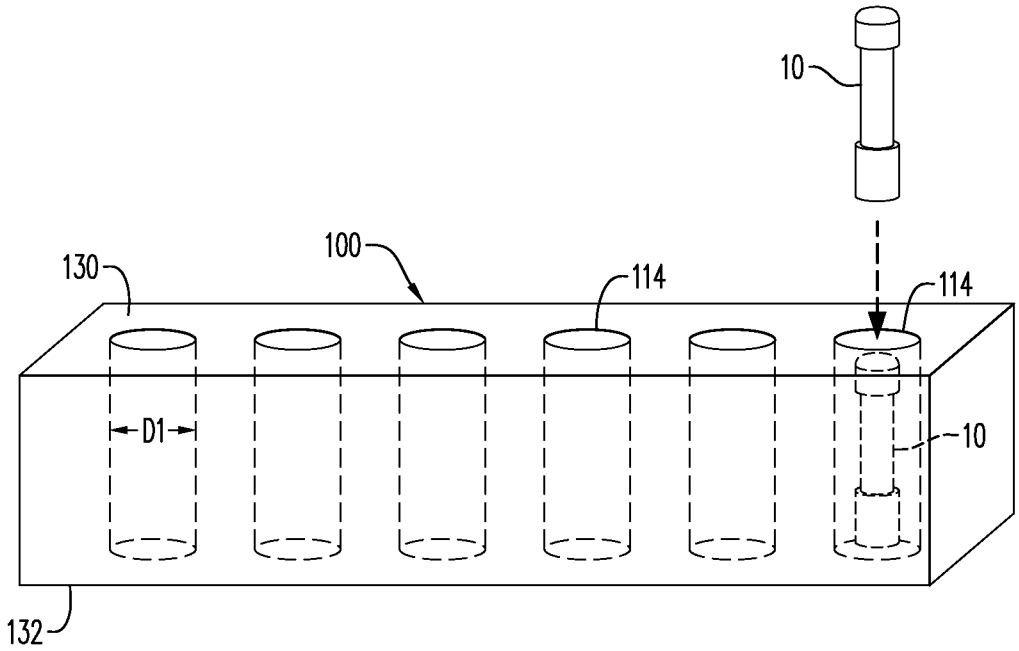
FIG. 7 is a side, perspective view of a drone magazine according to an embodiment.
Figure 8:
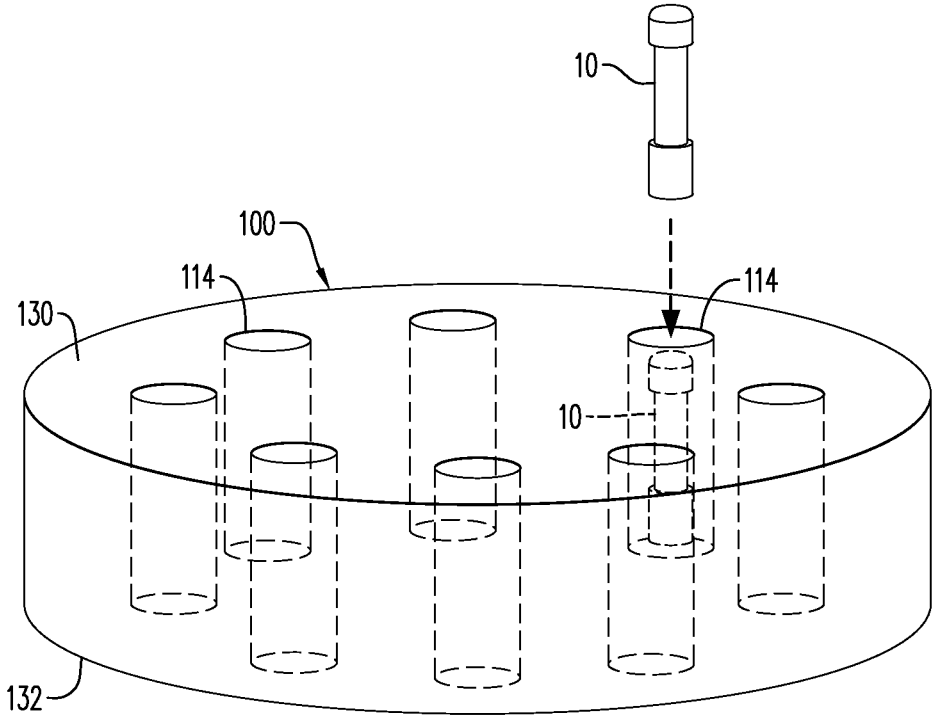
FIG. 8 is a side, perspective view of a drone magazine according to an embodiment.
Figure 9:
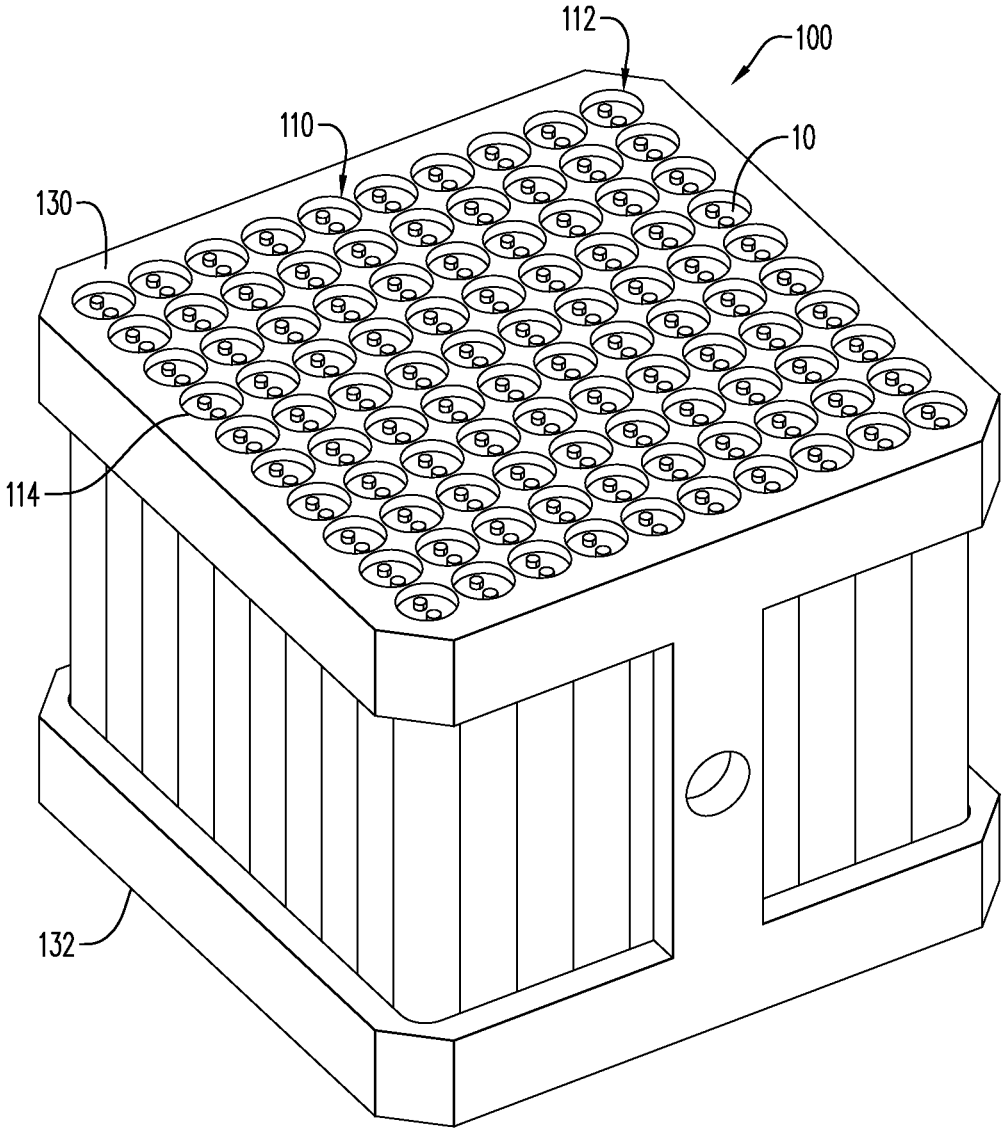
FIG. 9 is a side, perspective view of a drone magazine according to an embodiment.

As stated previously, a large number of potential drone magazine designs may be contemplated for use in the drone conveyance system 40. FIGS. 7, 8 and 9 illustrate some of these potential drone magazine designs, each such magazine having a top 130 and a bottom 132. FIG. 7 presents a magazine 100 having a linear array of drone chambers 114, with each drone chamber 114 sized to receive one drone 10, i.e., diameter D1 of drone chamber 114 is slightly larger than the diameter of the drone 10 therein to be disposed. The magazine embodiment shown in FIG. 8 has a plurality of drone chambers 114 arranged in a circle. The magazine embodiment shown in FIG. 9 has a plurality of drone chambers 114 arranged in a two-dimensional array, i.e., columns and rows, of drone chambers 114. Unlike the embodiment of FIG. 4, the drones 10 of the magazine embodiments of FIGS. 7, 8 and 9 are not loaded and unloaded from an end of the magazine 100. Rather, each drone 10 may be loaded and unloaded from the drone chamber 114 it occupies from the magazine top 130 and/or the magazine bottom 132.

Figure 17:
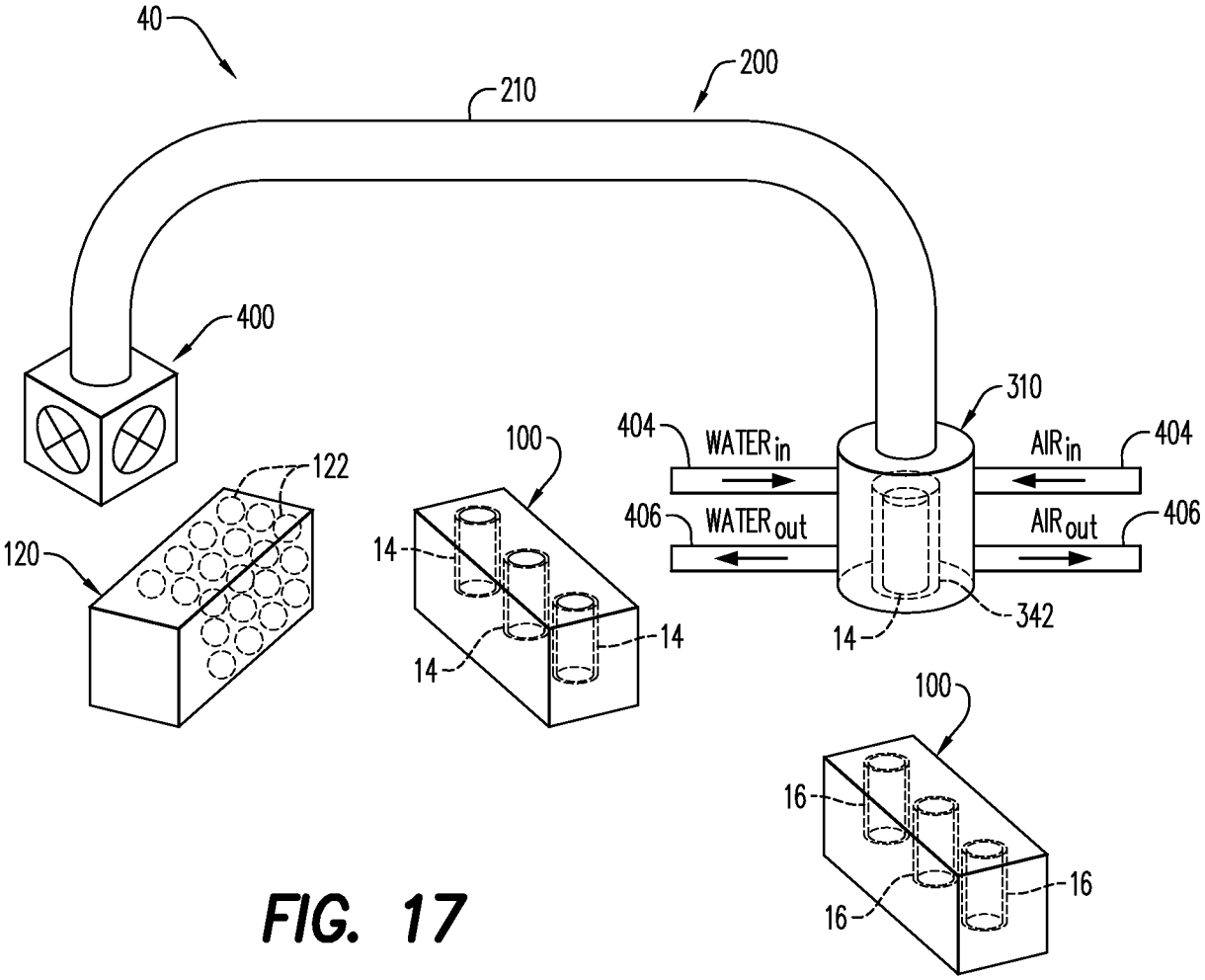
FIG. 17 is a perspective, plan view of a drone and drop-ball delivery apparatus according to an embodiment.

An illustrative example as to how one or more magazines 100 containing different groups of drones is shown in FIG. 17, with the different groups of drones having different functions, and may include a plug drone 16, a drop ball 122 and a perforating gun drone 14. A group of plug drones 16 occupy a first magazine 100 or a first section 110 of a magazine 100. A group of perforating gun drones 14 occupy a second magazine 100 or a second section 112 of a magazine 100. A drop ball magazine 120 contains a plurality of drop balls 122. A plug drone 16 may be selected from the first magazine 100 or the first section 110 of magazine 100, conveyed to the wellhead receiver 400 by the conveyance 200 and deployed from the wellhead receiver 400 through the wellhead 30 and into the wellbore 50. A drop ball 122 is then selected from the drop ball magazine 120, conveyed to the wellhead receiver 400 and deployed from the wellhead receiver 400 through the wellhead 30 and into the wellbore 50. The drop ball activates the plugging function of the plug drone 16. A perforating gun drone 14 may then be selected from the second magazine 100 or the second section 110 of the magazine 100, conveyed to the wellhead receiver 400 by the conveyance 200 and deployed from the wellhead receiver 400 through the wellhead 30 and into the wellbore 50. Once the perforating gun drone 14 reaches the point at which it is desired to perforate the wellbore 50, the perforating gun drone 14 may be automatically activated by an onboard processor/electronics or a signal may be sent to the onboard processor/electronics activating the perforating gun drone 14.

In an embodiment shown in FIG. 5, a plurality of magazines 100 that may be of the type shown in FIG. 4 are disposed on platform 300 and each magazine 100 may be connected to or positioned adjacent the lower receiving section 320 at a chamber opening 322. A mechanism associated with either the platform receiver 310 or the magazine 100 will move a drone 10 from the magazine 100, through the chamber opening 322 into the lower receiving chamber 324. For example, a compression spring (not shown) in the magazine 100 may exert a force on the drones 10, pushing them through the chamber opening 322. The force that moves the drone 10 into the lower receiving chamber 324 also advances the drones 10 in the magazine 100 such that the next drone in the magazine 100 is properly positioned for insertion into the lower receiving chamber 324 if selected.

In the FIG. 5 embodiment, the magazines 100 are arranged in a circle around the lower receiving section 320 of the platform receiver 310. In the event that the lower receiving section has a single chamber opening 322, the platform 300 may rotate such that each of the plurality of magazines 100 may be aligned with the chamber opening 322. That is, when it is desired that the next drone 10 to be loaded into lower receiving chamber 324 come from a particular magazine 100, the platform 300 is rotated such that the particular magazine aligns with the chamber opening 322, at which point a drone 10 is moved from the magazine 100 into the lower receiving chamber 324 through the chamber opening 322.

Figure 10:
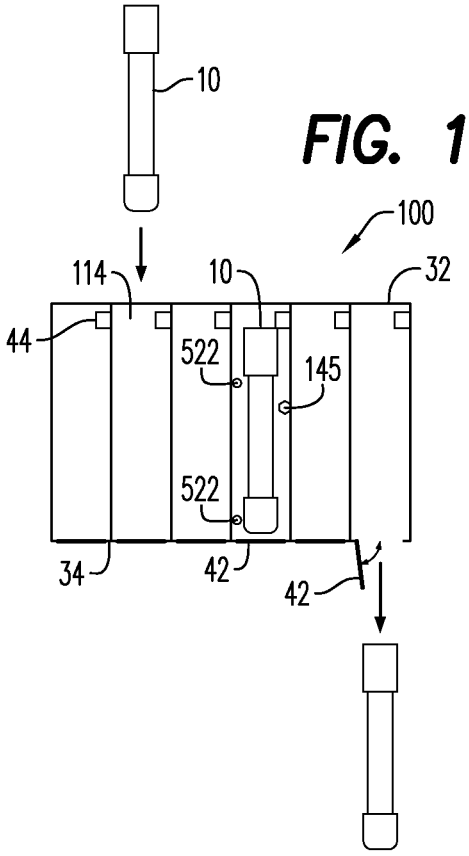
FIG. 10 is a side, cross-sectional, plan view of a drone magazine according to an embodiment.

As illustrated in FIG. 10, the drones 10 in the magazine 100 may be inserted at the top 32 or the bottom 34 of the magazine 100. The magazine chambers 114 may include a release element 42 for releasing the drone 10 from the magazine 100. The release element 42 moves between closed and open positions in order to facilitate the retention (when closed) of the drone 10 within the magazine 100, and the release (when open) of the drone 10. The release element 42 may be positioned laterally in a wall magazine chamber 114 or vertically at the magazine bottom 34. As shown in FIG. 10, the release element 42 may move between its open and closed positions by way of a sliding/retracting motion or a swinging motion. According to an aspect, the release element 42 moves into its open position based on information provided to the magazine 100 by a control unit 82 (see FIGS. 13 and 15) or by the drone 10.

The magazine 100 may also include at least one magazine transceiver 44 configured to communicate with the drone 10. According to an embodiment, the at least one magazine transceiver 44 is received within each of the magazine chambers 114. Alternatively, a single magazine transceiver 44 is provided with each magazine 100 and relays information regarding the drones 10. The magazine transceiver 44 may receive information transmitted from a communication with a drone transceiver included in the drone 10. According to an aspect, the drone transceiver may be as simple as a radio-frequency identification (RFID) tag, an optical marker such as a QR code or bar code or a data matrix code. It is contemplated that the magazine transceiver 44 may communicate with one or more transceivers included in the drone 10.

In an embodiment, the magazine transceiver 44 receives information from a plurality of sensors 145. The sensors 145 may be configured to perform at least one of a plurality of functions. According to an aspect, the sensors 145 are configured to detect the presence of the drone 10 in the magazine chamber 114. If the sensor 145 in one of the magazine chambers 114 determines that no drone 10 is present, the release element 42 corresponding with that magazine chamber 114 will remain in its closed position.

According to an aspect, the sensors 145 may distinguish between different types of drone 10. This may be particularly important when selecting the type of drone 10 that should be dispensed from the magazine 100. The sensors 145 may be configured to measure a voltage level of a battery housed within the drone 10.

Figure 13:
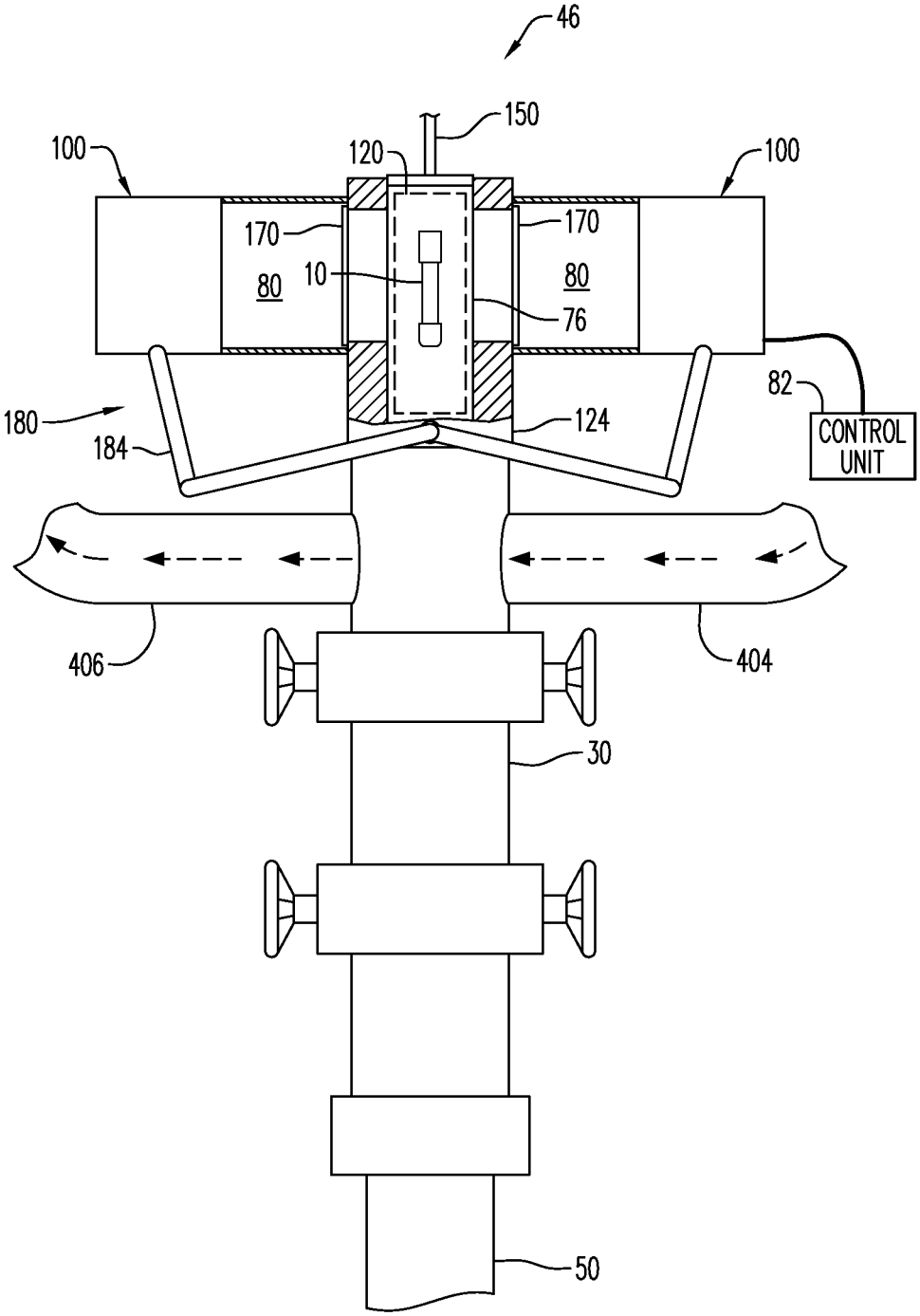
FIG. 13 is a side, partial cross-sectional, plan view of a launcher system with two attached magazines and a wellbore according to an embodiment.
Figure 15:
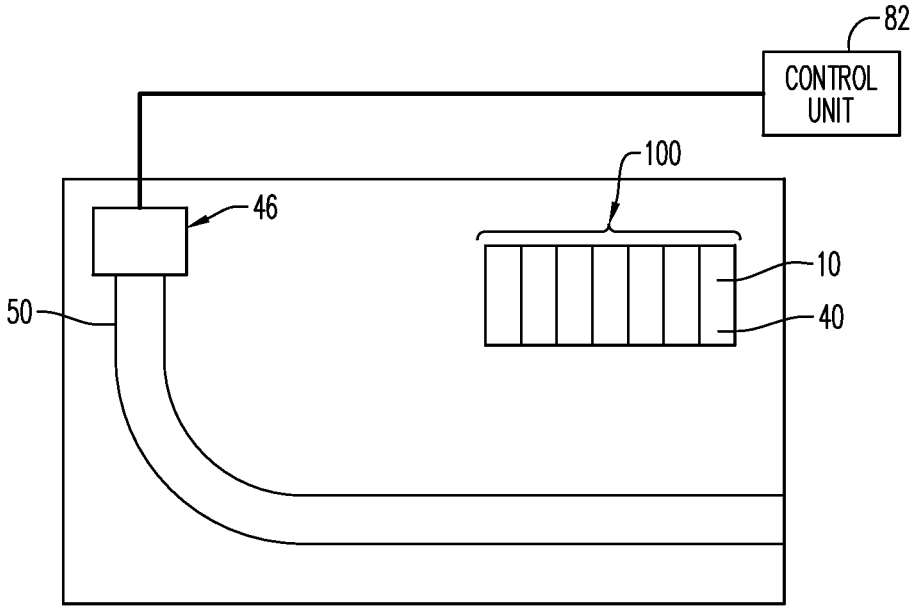
FIG. 15 is a side, cross-sectional, plan view of a launcher system, magazine, control unit and a wellbore according to an embodiment.

In an embodiment and with further reference to FIG. 10, the magazine 100 is configured to perform one or more self-tests in response to a command from a control unit 82 (see FIGS. 13 and 15). The control unit 82 may be electrically connected to one or more of the magazine 100, the magazine chambers 114 and the drone 10 by one of a direct-wired connection, a wireless local area network (LAN) connection, a wireless connection such as through a Bluetooth and a plug-in adapter connection. According to an aspect, each of the magazine chambers 114 is automatically locked in place based on the information received by the magazine transceiver 44 or the results of the one or more tests. The magazine chambers 114 may also include one or more safety device actuators 522, the function of which will be described with reference to FIGS. 21-23.

Figure 14:
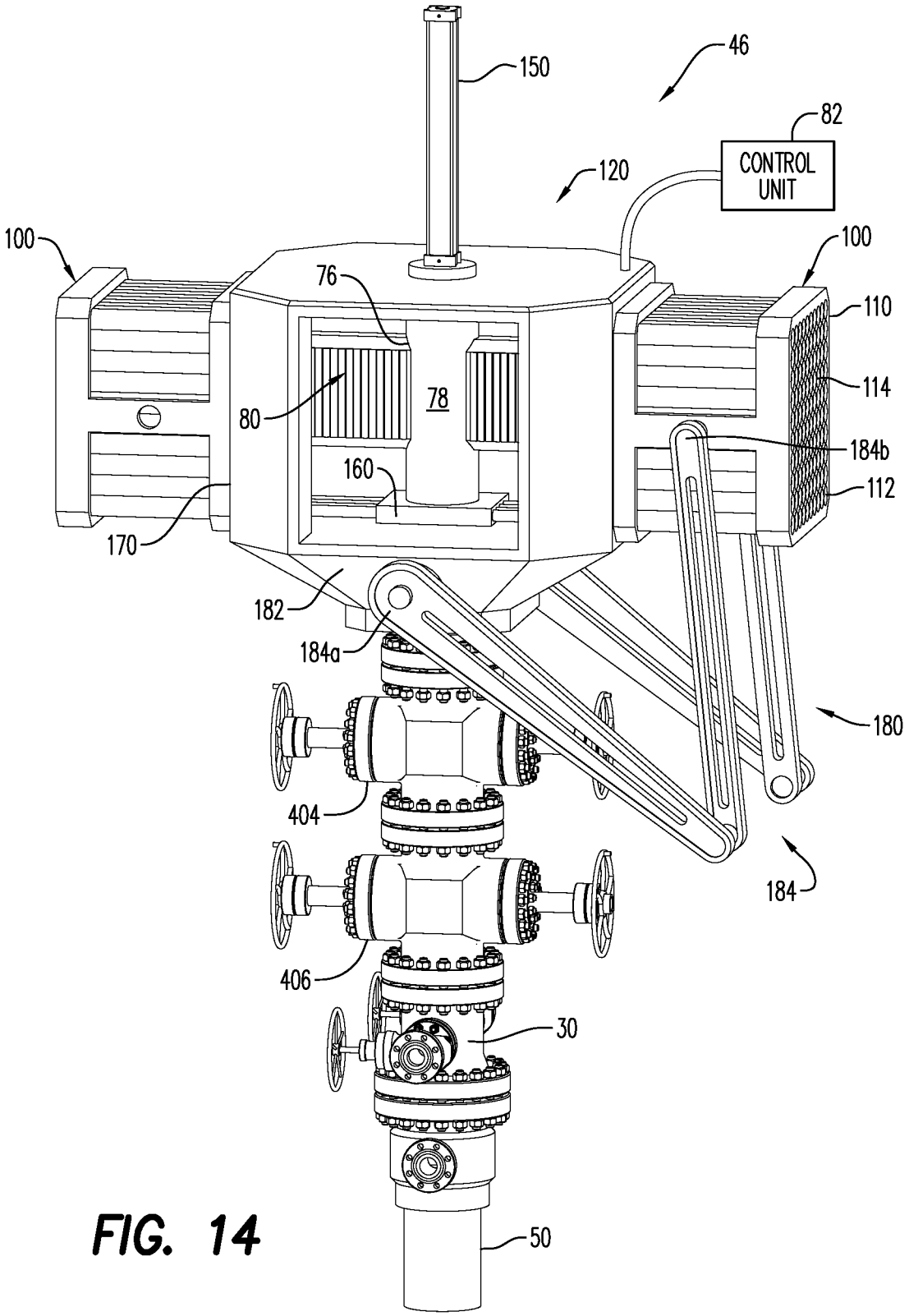
FIG. 14 is a side, partial cross-sectional, plan view of a launcher system with two attached magazines and a wellbore according to an embodiment.

As seen for instance in FIGS. 11-14, embodiments of the present disclosure further relate to a launcher/delivery system 46. As illustrated in FIG. 13 and FIG. 14, the launcher 46 may be positioned above or on top of standard wellbore pressure equipment that includes one or more lubrication inlets 404, outlets 406 and other equipment associated with a standard wellhead 30. The launcher 46 is configured for receiving a plurality of drones 10 and for dispensing them through the wellhead 30 and into an oil or gas wellbore 50. The drones 10 may be dispensed in an order that is preselected by an operator. Alternatively, each drone 10 may be selected by the operator as the next one to be inserted into the wellbore 50.

Figure 11:
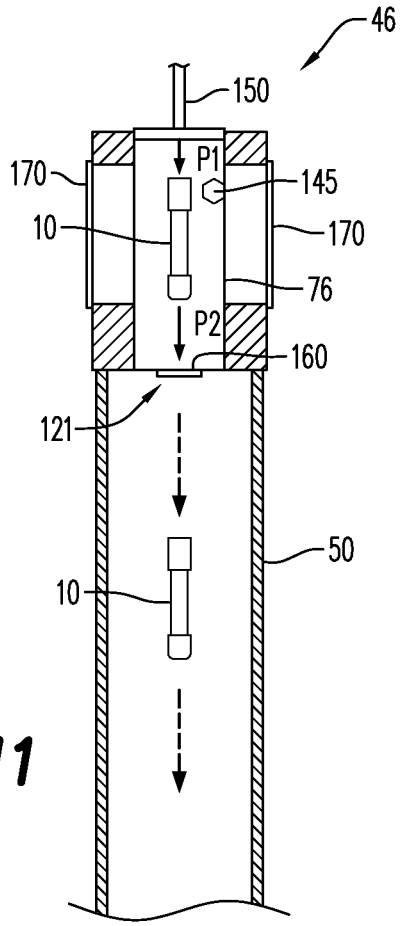
FIG. 11 is a side, cross-sectional, plan view of a launcher system according to an embodiment.
Figure 12B:
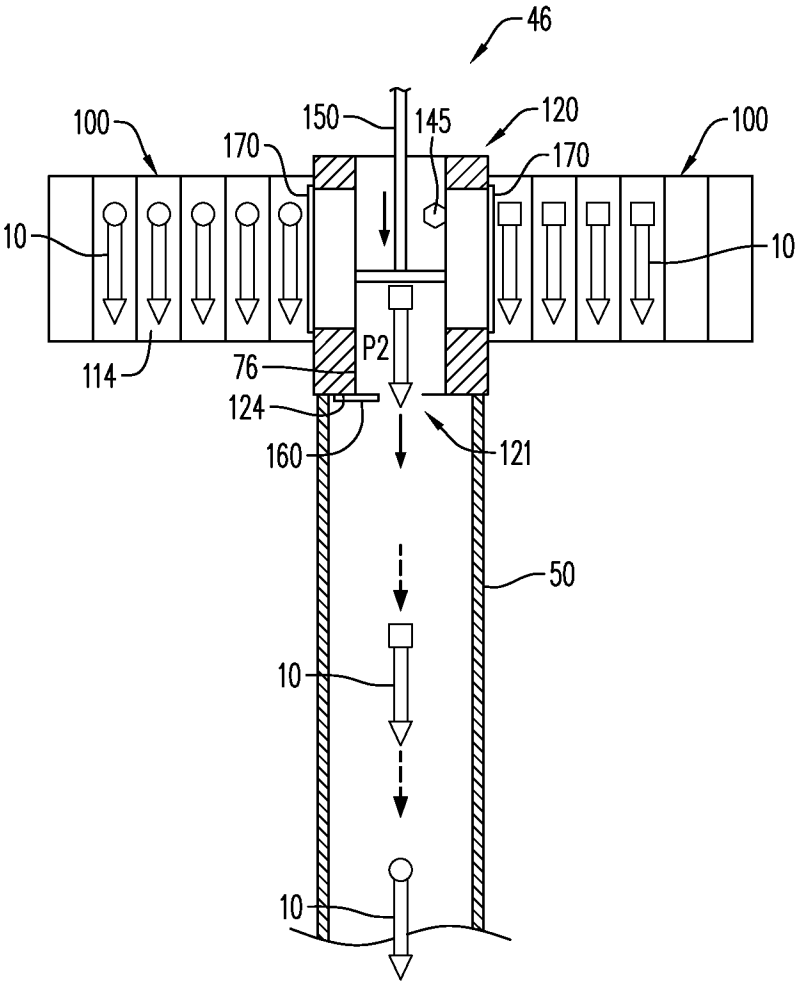
FIG. 12B is a side, cross-sectional, plan view of a launcher system with two attached magazines and a wellbore according to an embodiment.
Figure 12A:
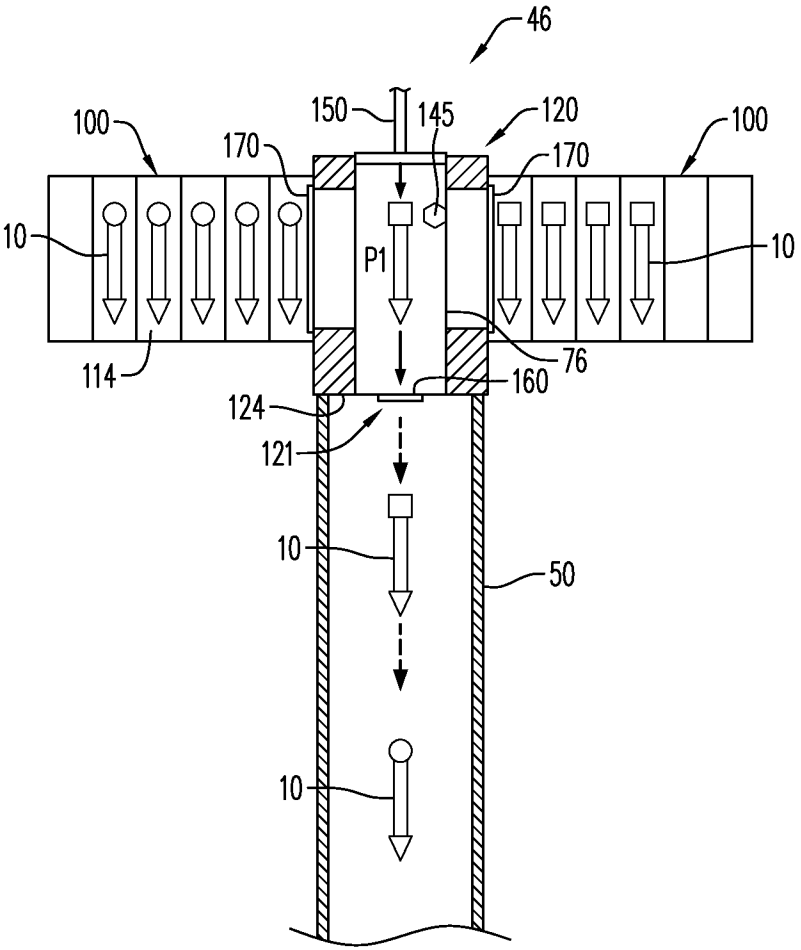
FIG. 12A is a side, cross-sectional, plan view of a launcher system with two attached magazines and a wellbore according to an embodiment.

FIG. 11 illustrates a simple version of the launcher 46 in detail. The launcher 46 includes a caisson 76. In an embodiment, the caisson 76 is air and water tight and may include a pressure rating of up to about 20,000 psi. The caisson 76 may be pressurized to a pressure that is equal to or greater than a wellbore pressure prior to dispensing/releasing the device to the wellbore but is also capable of achieving atmospheric pressure, e.g., when receiving a drone 10. Illustrated in the figures is a caisson having a generally rectangular shape, however, it is contemplated that the caisson 76 may have any desired shape.

According to an aspect and as illustrated in FIG. 14, the caisson 76 may additionally include a vertical chamber 78 and a horizontal chamber 80 that intersects the vertical chamber 78. According to an aspect, the chambers 78, 80 are in fluid communication with each other. The chambers 78, 80 provide a path for the drone 10 to enter the launcher 46, for instance in a horizontal direction through the horizontal chamber 80, and modality for rotating the drone 10 from the horizontal direction to the vertical direction in the vertical chamber 78 (not shown), and a path for the drone 10 to be dispensed from the launcher 46.

As illustrated in FIGS. 12A, 12B, 13 and 14, the launcher 46 may also include a magazine 100. The caisson 76 and magazine 100 are coupled together, so that the caisson 76 can continuously receive the drone 10 from the magazine 100, without requiring the use of additional equipment, such as a wireline. For purposes of convenience and not limitation, the general characteristics of the magazine 100, though applicable to the launcher 46, are described hereinabove.

According to an embodiment, each of the magazine chambers 114 may be configured for at least temporarily retaining and dispensing the drone 10 to the caisson 76 in the order selected by the operator. The release element 42 is provided to facilitate the dispensing of the drone 10 to the caisson 76. The general characteristics of the release element 42 applicable to the launcher 46 are similar to those described above with respect to FIG. 5. FIG. 7 illustrates the release element 42 adjacent the caisson 76. The release element 42 may be configured to periodically release the selected drone 10 to the caisson 76, with each drone 10 being selected and then released based on the type of drone 10 then required.

As discussed previously hereinabove, the magazine 100 may include a first section 110 and a second section 112 (see, e.g., FIG. 9). According to an aspect, the drones 10 in the first section 110 of the magazine 100 may be of same type and the drones 10 in the second section 112 may be of a different type from those in the first section 110. For example, the drones 10 in the first section 110 may be perforating guns while those in the second section 112 may be frac plugs. Similarly, more than one magazine 100 may be attached to the launcher 46, with each distinct magazine 100 containing a different type of drone. Thus, each of magazine 100 attached to the left side of the launcher 46 in any one of FIGS. 12A, 12B, 13 and 14 may contain perforating gun drones while the magazine attached to the right side of the launcher 46 may contain frac plug drones. According to an aspect, an operator of the launcher 46 selects which of the magazines 100 dispenses the next drone 10 into the caisson 76. Alternatively, the dispensing of the drone 10 could be pre-configured and automatically dispensed by the control unit 82.

According to an aspect, the launcher 46 may include a drone launcher loading system 180. FIGS. 13 and 14 illustrate the launcher loading system 180 in detail. The launcher loading system 180 may operate with a plurality of the magazines 100 and may move the magazines 100 from a first location to a second location. For example, the launcher loading system 180 may transport the magazines 100 from any location that is spaced in proximity to the caisson 76, such as a storage area, truck, pallet, fork lift, etc., to operative communication with the caisson 76. The launcher loading system 180 may include a base 182 secured to the bottom portion 124 of the caisson 76, and at least one arm 184 extending from the base 182. According to an aspect, a first end 184*a* of the arm is connected to the base 182 and a second end 184*b* of the arm is connected to the magazine 100. The second end 184*b* may move relative to the first end 184*a*, to facilitate the transport of the magazine 100 to and from different locations.

In order to facilitate the entry of the drone 10 into the caisson 76, at least one door 170 is formed in the caisson 76. The door 170 may be at least one of a pressure-locked door and a pneumatic door, and may be formed at a top wall or a side wall of the caisson 76.

According to an aspect, the door 170 is moveable between closed and open positions. The door 170 may move to the open position when the magazine chambers 114 and the caisson 76 have substantially equal pressures, typically atmospheric pressure. A pressure equalizer may help to facilitate the equalization of the pressure within the caisson with the atmospheric pressure of the magazine chambers 114. In an embodiment, the magazine 100 dispenses one of the drone 10 into the caisson 76 when the magazine chamber 114 and the caisson 76 are at substantially equal pressures. The drone 10 may be received and locked into place at the first position P1 or the second position P2. After the drone 10 enters the caisson 76, the door 170 closes is closed and pressure sealed. Additional drones 10 may be delivered to the door 170 by one of manual instructions controlled by an operator and pre-programmed instructions comprising automated sequences.

As illustrated in FIGS. 11-14, the launcher 46 may be configured with a launch element 150. The launch element 150 is attached to the caisson 76 and is configured to exert a force on the drone 10 within the caisson 76. The force exerted by the launch element may be used to change the position of the drone within the caisson and/or to launch the drone 10 from the caisson into the wellbore 50.

According to an aspect, the launch element 150 displaces the drone 10 from a first position P1 (FIG. 12A) in the caisson 76 to a second position P2 (FIG. 12B) in the caisson 76. The caisson 76 may include one or more sensors 145 to sense when the drone 10 is positioned at the first position P1, and when the drone 10 is positioned at the second position P2. According to an aspect, when the sensor 145 senses that the drone 10 is at the second position P2, any entrance 170 of the caisson 76 automatically closes and seals. This helps to secure the drone 10 within the caisson 76 and may additionally help to maintain the pressure inside the caisson 76. Once all entrances 170 are closed, the caisson 76 may be pressurized to a pressure at or above the pressure in the wellbore utilizing the lubrication input 404 and lubrication output 406.

The release of the drone 10 from the caisson 76 to the wellbore 50 may be facilitated by a release mechanism 160. As illustrated in FIGS. 7-8, the release mechanism 160 forms a lower boundary of the caisson 76. According to an aspect, the release mechanism 160 is pressure locked and pneumatic. The release mechanism 160 is moveable between open and closed positions. In the closed position, the release mechanism 160 is pressure sealed, which prevents outside pressures, liquids, debris or devices from entering or backing up into the caisson 76 from the wellbore 50. The release mechanism 160 may be activated to open the fluid connection port 121 in the caisson 76. In an embodiment, the launch element 150 may engage or reengage the drone 10 to exert a force on the drone 10 to move it through the fluid connection port 121, through the wellhead 30, past any structures associated with the wellhead 30 and into the wellbore 50.

The launcher 46 may communicate with the control unit 82. The components of the launcher 46 may also be configured to communicate with or generate data that is captured by the control unit 82. The control unit 82 may be electrically connected to the launcher 46 by one of a direct-wired connection, a wireless local area network (LAN) connection, a Bluetooth connection, and an adapter plug-and-go connection. According to an aspect, the control unit 82 sends commands to various components of the launcher 46.

According to an aspect, the caisson 76 is configured to perform one or more self-tests in response to a command from the control unit 82. Such self-tests may include a pressure check of the caisson 76 and each of the magazine chambers 114, to determine whether pressure has been equalized within the caisson 76 to permit movement of the drone 10 from the magazine chambers 114 into the caisson 76 as well as from the caisson 76 into the wellbore 50.

In an embodiment, the control unit 82 may send commands to the magazine 100 to release one of the drones 10 to the caisson 76. The door 170 of the caisson 76 may also receive a command from the control unit 82 to open/close so that the drone 10 can be received by the caisson 76 in preparation for deployment into the wellbore 50. According to an aspect, the commands of the control unit 82 may include manual instructions input by an operator. The instructions may be pre-programmed and may include automated self-tests, as well as dispense sequences that trigger the drone 10 being dispensed from the magazine 100 into the caisson 76 and the drone 10 being deployed into the wellbore 50. In an embodiment, the release mechanism 160 may be locked into its closed position until the control unit 82 sends instruction to the magazine 100 to facilitate the opening of the release mechanism 160. It is contemplated that the instructions may be sent only if the drone 10 passes several performance and quality tests, which may be facilitated by the electrical contacts on the drone 10 (not shown). This may prevent the release of a faulty device, such as a drone that may have failed one or more performance or quality tests, into the caisson 76 or into the wellbore 50.

Similar to the embodiment illustrated in FIG. 5, in the drone conveyance system 40 illustrated in FIG. 6, the platform receiver 310 may be provided with a chamber opening 322 sized to permit the insertion of a drone 10 into a receiving chamber 342 located inside the platform receiver 310. A magazine 100 in accordance with any of FIG. 7, 8 or 9 may be supported by the platform 300. The magazine 100 is moved relative to the platform receiver 310 until the desired drone chamber 114 is adjacent the chamber opening 322, at which point the selected drone 10 is moved from the magazine 100, through the chamber opening 322 into the receiving chamber 342. Movement of the drone 10 into the receiving chamber 342 is performed by an actuator, lift, fluid pressure burst or similar mechanism (not shown) associated with the platform 300 or the magazine 100. Due to the top and/or bottom loading ability of each of the FIGS. 7, 8 and 9 magazine 100 embodiments, in contrast to the end loading ability of the FIG. 4 magazine 100, any drone 10 of the FIGS. 7, 8 and 9 magazines 100 may be accessed for insertion at any time. Thus, if the tool details of each drone 10 loaded in each drone chamber 114 of the FIGS. 7, 8 and 9 magazines 100 is recorded, then drones 10 may be dropped into the wellbore 50 in any desired order by simply moving the magazine 100 such that the selected drone chamber 114 is opposite the chamber opening 322 prior to movement of the selected drone 10 into the receiving chamber 342.

Figure 16:
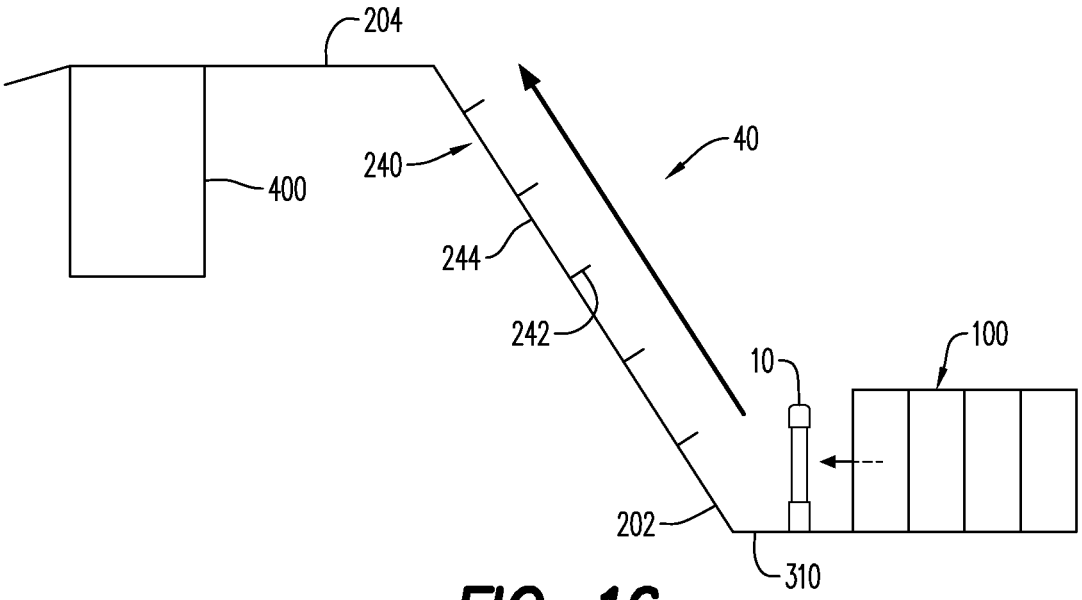
FIG. 16 is a side, plan view of a drone delivery apparatus according to an embodiment.

The embodiment of the drone conveyance system 40 illustrated in FIG. 16 is somewhat simplified. In particular, to the extent there is a platform receiver 310 at all, its structure is greatly simplified. The simplified drone conveyance system includes a ramp 240, conveyer 244 and plurality of sleds 242 attached to the conveyer. By way of example, the conveyer 244 may be conveyer belt or conveyer chain, either one of which may be formed in a continuous loop. The sleds 242 may be attached to the conveyer and carried on the continuous loop. The sleds 242 serve the function of engaging a drone 10 at the conveyance entrance 202 and conveying the drone 10 to the conveyance exit 204, where it may be deposited in the wellhead receiver 400. The magazine 100 may be designed to present a drone 10 for engagement by a conveyor sled 242. Alternatively, an intervening element may convey a drone 10 from the magazine to a position where it may be engaged by a conveyor sled 242. In an embodiment similar in many ways to the drone conveyance system 40 illustrated in FIG. 16, ramp 240 may also take the form of a rail; sled 242 will be attached to the rail and engage the drone 10 for conveyance from the entrance 202 to the exit 204 of the conveyance 200.

FIG. 17 illustrates a generalized drone conveyance system 40 that includes a platform receiver 300, elongate conveyance chamber 210 and wellhead receiver 400. The magazine 100 illustrated in FIG. 17 is of the type shown in FIG. 7. An alternative magazine shown in FIG. 17 is the drop ball magazine 120 holding a plurality of drop balls 122. The drop ball magazine 120 may be connected to the platform receiver 300. When it is desired to deploy the drop ball 122 in the wellbore 50, the drop ball 122 is inserted in the receiving chamber 342 of the platform receiver 310 and conveyed to the wellhead receiver 400 by the conveyance 200. Drop balls 122 and their various functions are well known in the art. For example, a downhole tool 20 may be activated by the drop ball 122. Alternatively, the drone 10 in combination with the drop ball 122 may result in a change in fluid flow through the tool. Once the drop ball 122 engages the tool opening, fluid will no longer flow through the tool and, thus, the tool ceases performing a particular function and/or is prepared to perform a different function.

Figure 18:
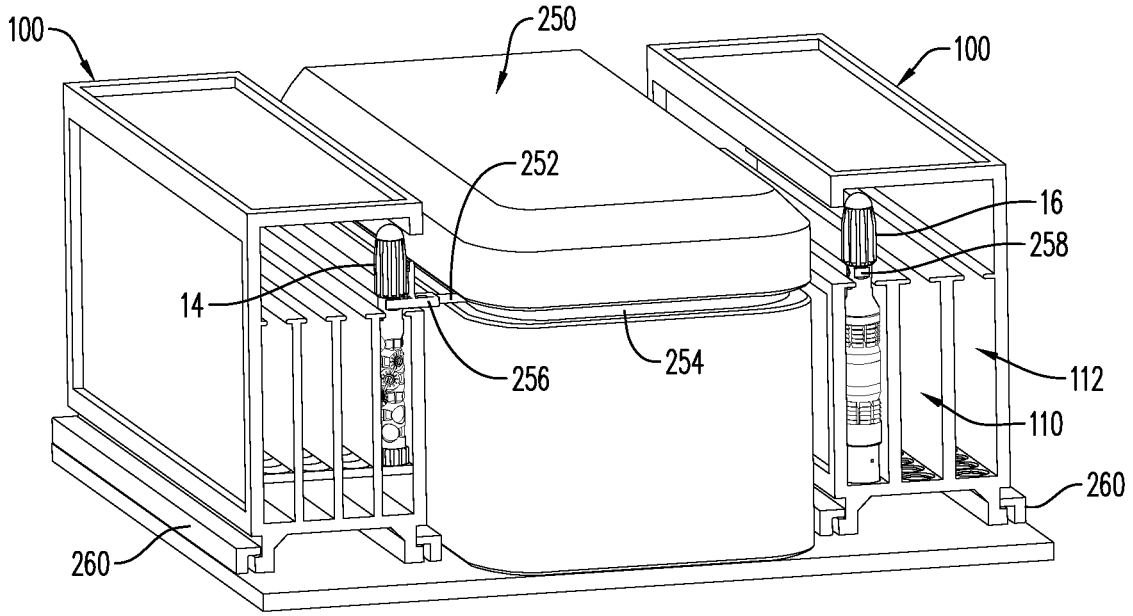
FIG. 18 is a perspective, plan view of an automatic drone selector module with a drone magazine on either side thereof.
Figure 19:
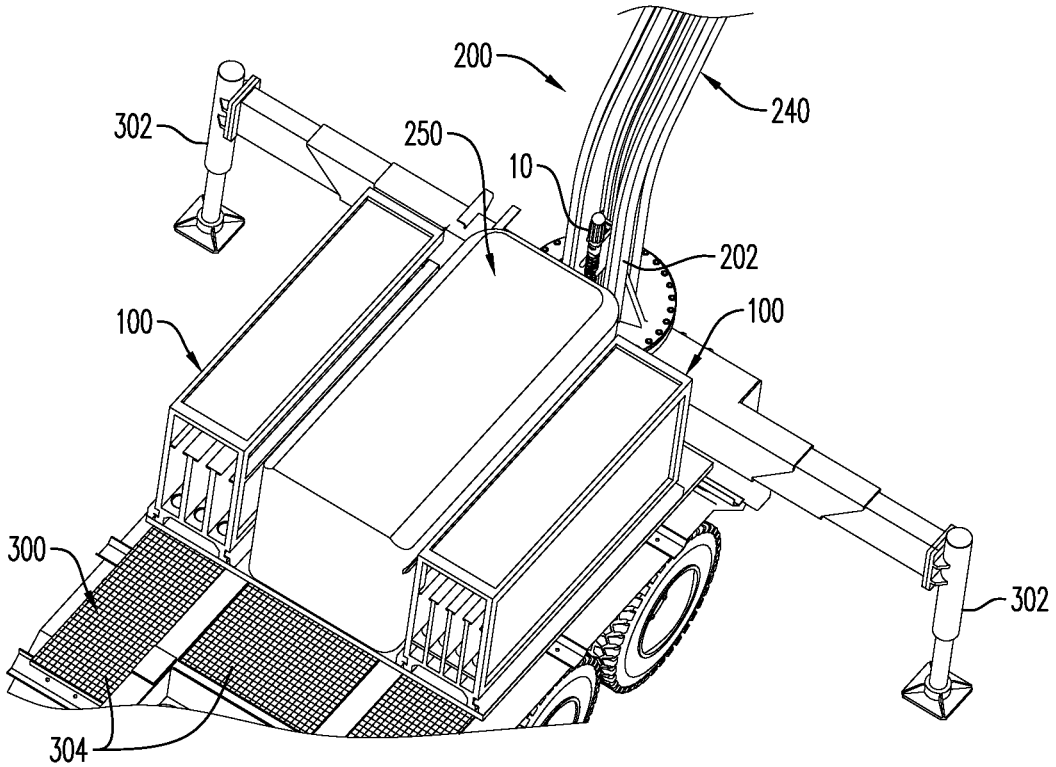
FIG. 19 is a top, perspective view of the drone selector and magazines of FIG. 18 mounted on a platform.
Figure 20:
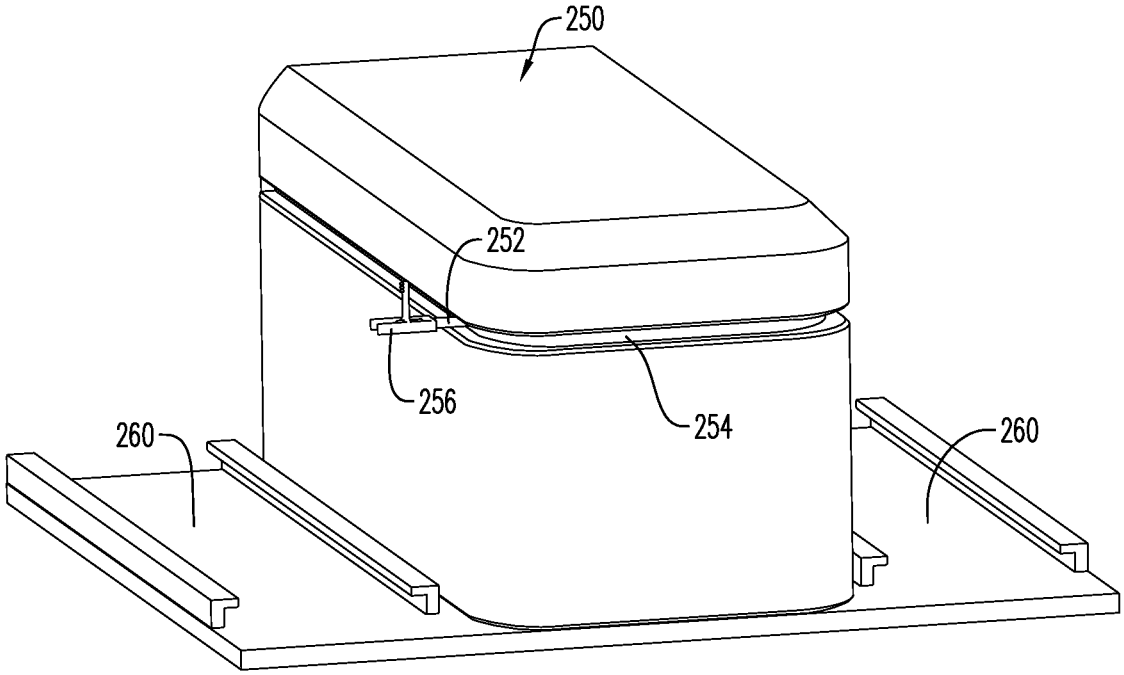
FIG. 20 is a perspective, plan view of the drone selector of FIG. 18 without any drone magazines mounted in the magazine rails on either side of the drone selector.

FIGS. 18, 19 and 20 illustrates a semi- or fully-automated system for selecting the drone 10 to be loaded on conveyance 200 from platform 300. An automatic selector unit 250 has a selector arm 252 and a selector arm window 254. The selector arm 252 may move from one side of the selector unit 250 to the other, traveling along a path defined by selector arm window 254. The drivers for selector arm 252 are contained in the selector unit 250 and within the selector arm 252 itself. Control of the selector arm 252 drivers may be achieved with control systems/software contained in or attached to selector unit 250 or control systems/software communicating with the selector unit 250 remotely, i.e., anywhere from a several meters to kilometers away from the selector unit 250.

The selector arm 252 has an engagement element 256 at the end thereof and the drivers for the selector arm 252 may also actuate the engagement element 256 axially away from and toward the selector unit 250. The engagement element 256 of selector arm 252 is designed to securely engage a securing portion 258 of the drone 10. The securing portion 258 of the drone 10 derives its name from the function of allowing the drone 10 to be securely engaged by the engagement element 256.

As seen in FIG. 18 and as previously presented regarding FIG. 4, a single magazine 100 may contain multiple sections, e.g., first section 110, second section 112, etc. Axial movement of the drone engagement element 256 allows the drone engagement element 256 to engage a drone in any one of the several sections, e.g., 110 or 112, of the two magazines 100 to the right and left of the selector unit 250. FIG. 18 shows the drone engagement element 256 engaging securing portion 258 of the selected drone, in this case a perforating gun drone 14, from the side of the magazine 100. The securing portion 258 is more visible in the plug drone 16 that is not currently being engaged by engagement element 256 of selector arm 252 in FIG. 18.

It is also contemplated that the drone engagement element 256 could be configured to engage the selected drone 10 from the front of the magazine 100. If engaging from the side, the selected drone 10 may be aligned with the axially moving drone engagement element while unselected drones are not in the way of the axial movement of the engagement element 256. If engaging from the front of the magazine 100, the axial movement of the engagement element 256 would not be impeded by the drones in other magazine sections. Rather, the engagement element 256 would move axially until it aligned with the magazine section containing the selected drone 100, at which point the arm 252 would move the engagement element 256 into engagement with the securing portion 258 of the selected drone 10.

Once engagement element 256 is securely engaged to the drone 10, the selector arm 252 may be moved along the selector arm window 254 by drivers in the selector unit in order to remove the drone 10 from the magazine 100 and move it toward the conveyance 200. After aligning the drone 10 with the conveyance entrance 202, axial movement of the engagement element 256 inserts the drone 10 into the conveyance entrance 202. In the circumstance that a ramp/rail 240 conveyance 200 is being utilized, a sled 242 will engage the drone 10 and the selector arm 252 is disengaged from the drone. Sled 242 is best shown in FIG. 3 and FIG. 16. The selector arm 252 is now available to retrieve another drone 10 from any section of either magazine 100.

In an embodiment, a plurality of drones 10 may be connected together in a drone string. The connection of drones 10 may be performed at the conveyance entrance 202, with the selector arm 252 shuttling back and forth from the magazines 100 and connecting one drone 10 at a time to create the drone string.

As seen in FIG. 3 and FIG. 19, the platform 300 supporting the automatic selector unit 250 may be in the form of a semi-truck bed provided with platform stabilizers 302. Alternatively, platform 300 may be disposed on the ground or on any appropriate support structure. Whatever the disposition of platform 300, a plurality of sliding platform supports 304 may be provided for ease of movement of the automatic selector unit 250 and, more importantly, the magazines 100. As best seen in FIG. 20, a set of magazine rails 260 may be located on either side of the automatic selector unit 250. The magazine rails 260 may slidingly receive and secure a magazine 100 for access by the selector arm 252 of the engagement element 252. Since each magazine 100 may be fairly massive, especially when loaded with drones 10, preloading the magazines 100 on sliding platform supports 304 on the platform 300 allows for the magazines 100 to be more easily moved on the platform 300 relative to the selector unit 250. An empty or unneeded magazine 100 may be slid off of the magazine rails 260 and on to a sliding platform support 304. This platform support 304 may then be moved away from the selector unit 250 while the required magazine 100 is slid on its sliding platform support 304 into a position adjacent the magazine rails 260 and then off of its sliding platform support 304 into engagement with the magazine rails 260.

Obviously, a substantial number of magazines 100 may be contained on a platform 300 and restocked at any time. Restocking may involve loading drones 10 into a magazine 100 disposed on the platform 300 or the removal of an empty magazine 100 from platform 300 and replacement with a full magazine 100.

In an embodiment, the drone 10 is subjected to pre-deployment testing to confirm that the drone 10 being programmed, charged, armed and tested to satisfy a given set of parameters. The parameters may be set to confirm that the drone 10 will operate as desired in the wellbore 50. The parameters may also be set to confirm that the drone selected is of the correct configuration sought to be next dropped into the wellbore 50. Electrical or signal connections associated with the selector arm 252 may perform this testing once the selector arm 252 engages the drone 10. Alternatively or additionally, sensors 145 of the type illustrated in FIGS. 10, 11 and 12 may be utilized for pre-deployment testing.

Figure 21A:
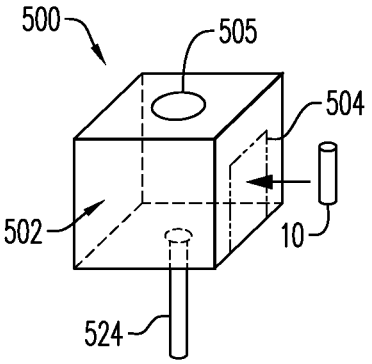
FIGS. 21A, 21B and 21C are side, perspective views illustrating a 'positive' result test procedure on a drone.
Figure 21B:
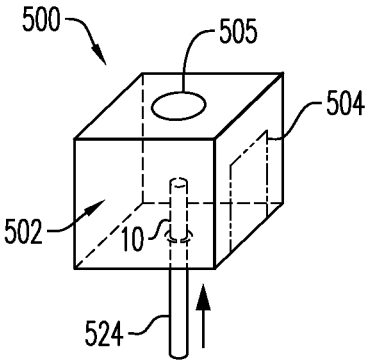
Figure 21C:
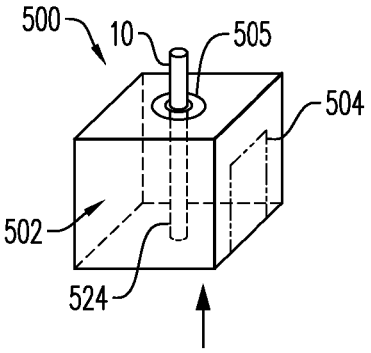
Figure 22A:
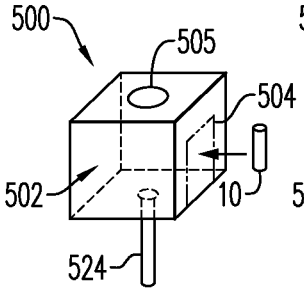
FIGS. 22A, 22B, 22C and 22D are side, perspective views illustrating a 'negative' result test procedure on a drone.
Figure 22B:
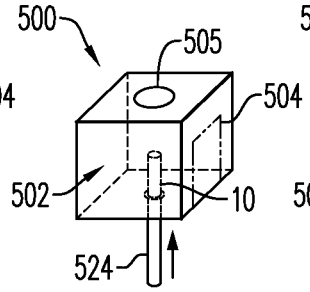
Figure 22C:
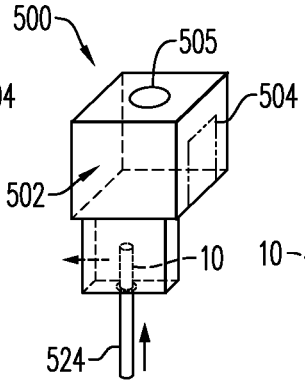
Figure 22D:
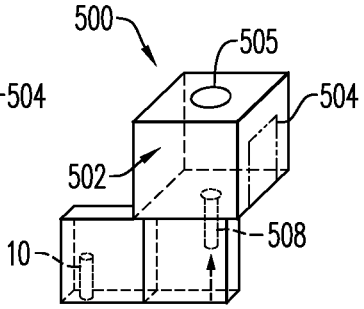
Figure 23A:
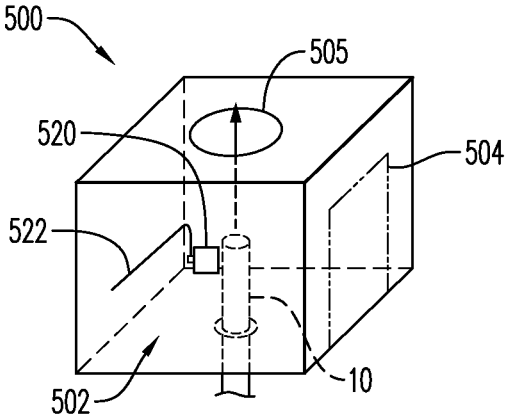
FIGS. 23A and 23B are side, perspective views illustrating the activation of a drone by actuation of a safety device.
Figure 23B:
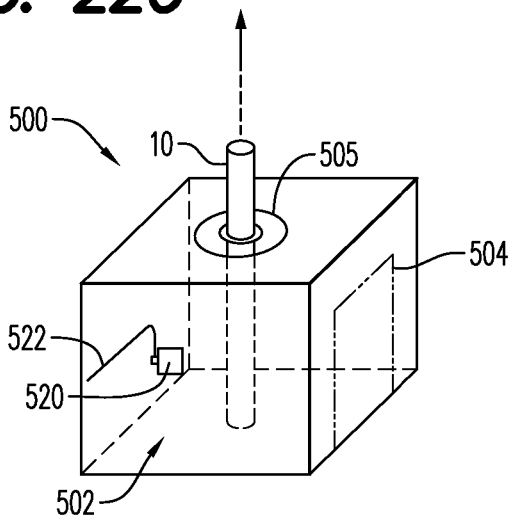

FIG. 21A shows an embodiment having a testing unit 500 that includes a testing chamber 502 and a testing chamber entrance 504, through which a drone 10 is passed into the testing chamber 502 of the testing unit 500. FIG. 21A and FIG. 22A show the drone 10 being inserted into the testing chamber 502 of the testing unit 500 through the testing chamber entrance 504. After being conveyed into the testing unit 500, electrical or signal connections are established with the drone 10 and a set of parameters are tested. In the event of positive results for the tested parameters, the drone 10 is moved by pass actuator 524 to the next portion of the drone conveyance system 40 through a pass exit 505, as illustrated in FIG. 21C. However, in the event of negative results for the tested parameters, the rejected drone exits the testing unit through a rejection exit 508, as illustrated in FIG. 22B. The rejection exit 508 may deposit the rejected drone into a simple discard bin (not shown) or may collect the rejected drones in a rejection magazine 506 for shipment, storage, disposal, repair and/or further testing.

The testing chamber 320 may be a separate structure in the drone conveyance system 40 or, more simply, may be co-located in a structure previously presented in this disclosure. For example, the testing chamber 320 and associated structures may be integrated with the platform receiver 310 or the wellhead receiver 400. Thus, for example, locating the testing chamber 320 in the platform receiver 310 means that the testing chamber entrance 504 may be the same as the chamber opening 322 and the testing chamber 502 may be the same as the upper receiving chamber 332 or the lower receiving chamber 324.

Drone programming, i.e., providing instructions to electronics inside the drone 10, may be accomplished either previous to or simultaneously with pre-deployment testing. The details of the programming provided to a particular drone 10 will depend upon the type of drone it is and the details of the job being performed.

Downhole tools 20 often have activation pins or latches that prevent certain functions from occurring prior to the tool being deployed in wellbore 50. For example, in the event that the downhole tool 20 contains explosives or pyrotechnics, it is very important to prevent initiation of these elements prior to dropping the tool into the wellbore. As seen in FIGS. 22A and 22B, a safety device 520 may be included with each drone 10 that prevents some or all functions of the drone 10. Removal or deactivation of the safety device 520 is achieved by a safety device actuator 522 prior to disposal of the drone 10 into the wellbore 50. As such, the safety device actuator 522 may be associated with, for example, the testing chamber 502, the wellhead receiver 400 or the platform receiver 310. Such a safety device actuator 522 is also shown in FIG. 10.

Figure 24:
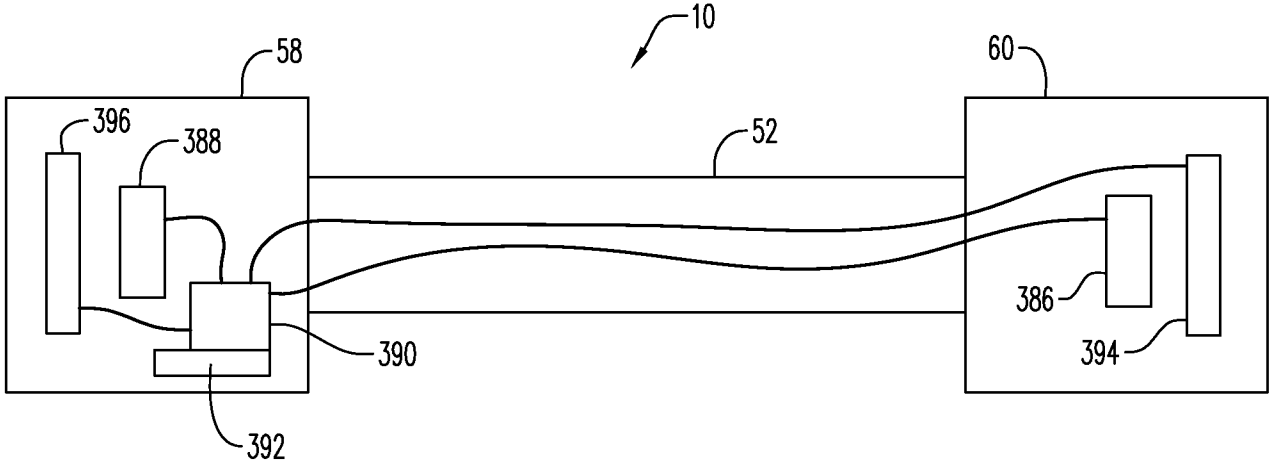
FIG. 24 is a side, cross-sectional plan view of a generic drone 10 in accordance with an embodiment.

Further to pre-deployment of the drone 10, various types of drone 10 may include various combinations of electronic components or components that require electric power. Examples of such electronic components include a computer/processor 390, a detonator, various sensors 145, coils 394, 396 and signal transceivers 386, 388. FIG. 24 shows generic drone 10 that may be programmed, charged, armed and/or tested to satisfy a given set of parameters. The drone 10 illustrated in FIG. 24 may represent any type of drone.

By way of example, the drone 10 may take the form of the perforating gun 14 shown in FIG. 2. The body portion 52 of the drone 10 may bear one or more shaped charges 62. As is well-known in the art, detonation of the shaped charges 62 is typically initiated with an electrical pulse or signal supplied to a detonator housed in the drone 10. The detonator of the perforating gun embodiment of the drone 10 may be located in the body portion 52 or adjacent the intersection of the body portion 52 and the head portion 58 or the tail portion 60 to initiate the shaped charges 62 either directly or through an intermediary structure such as a detonating cord housed in detonating cord track 72.

As would be understood by one of ordinary skill in the art, electrical power typically supplied to wellbore tools 20 via the wireline cable 24 would not be available to the drone 10 as disclosed herein. Thus, in order for all components of the drone 10 to be supplied with electrical power, a power supply 392 may be included as part of the drone 10. The power supply 392 may occupy any portion of the drone 10, i.e., one or more of the body 52, head 58 or tail 60. It is contemplated that the power supply 392 may be disposed so that it is adjacent any components of the drone 10 that require electrical power.

An on-board power supply 392 for the drone 10 may take the form of an electrical battery; the battery may be a primary battery or a rechargeable battery. Whether the power supply 392 is a primary or rechargeable battery, it may be inserted into the drone at any point during construction of the drone 10 or immediately prior to insertion of drone 10 into the wellbore 30. If a rechargeable battery is used, it may be beneficial to charge the battery immediately prior to insertion of the drone 10 into the wellbore 30. Charge times for rechargeable batteries are typically on the order of minutes to hours.

In an embodiment, another option for power supply 392 is the use of a capacitor or a supercapacitor. A capacitor is an electrical component that consists of a pair of conductors separated by a dielectric. When an electric potential is placed across the plates of a capacitor, electrical current enters the capacitor, the dielectric stops the flow from passing from one plate to the other plate and a charge builds up on the plates. The charge of a capacitor is stored as an electric field between the plates. Each capacitor is designed to have a particular capacitance (energy storage). In the event that the capacitance of a single capacitor is insufficient, a plurality of capacitors may be used. When a capacitor is connected to a circuit, a current will flow through the circuit in the same way as a battery, i.e., electrical charge will flow from the negatively charged plate to the positively charged plate. That is, when electrically connected to elements that draw a current the electrical charge stored in the capacitor will flow through the elements. Utilizing a DC/DC converter or similar converter, the voltage output by the capacitor will be converted to an applicable operating voltage for the circuit. Charge times for capacitors are on the order of minutes, seconds or even less.

A supercapacitor operates in a similar manner to a capacitor except there is no dielectric between the plates. Instead, there is an electrolyte and a thin insulator such as cardboard or paper between the plates. When a current is introduced to the supercapacitor, ions build up on either side of the insulator to generate a double layer of charge. Although the structure of supercapacitors allows only low voltages to be stored, this limitation is often more than outweighed by the very high capacitance of supercapacitors compared to standard capacitors. That is, supercapacitors are a very attractive option for low voltage/high capacitance applications as will be discussed in greater detail hereinbelow. Charge times for supercapacitors are only slightly greater than for capacitors, i.e., minutes or less.

A battery typically charges and discharges more slowly than a capacitor due to latency associated with the chemical reaction to transfer the chemical energy into electrical energy in a battery. A capacitor is storing electrical energy on the plates so the charging and discharging rate for capacitors are dictated primarily by the conduction capabilities of the capacitors plates. Since conduction rates are typically orders of magnitude faster than chemical reaction rates, charging and discharging a capacitor is significantly faster than charging and discharging a battery. Thus, batteries provide higher energy density for storage while capacitors have more rapid charge and discharge capabilities, i.e., higher power density, and capacitors and supercapacitors may be an alternative to batteries especially in applications where rapid charge/discharge capabilities are desired.

Thus, an on-board power supply 392 for a drone 10 may take the form of a capacitor or a supercapacitor, particularly for rapid charge and discharge capabilities. A capacitor may also be used to provide additional flexibility regarding when the power supply is inserted into the drone 10, particularly because the capacitor will not provide power until it is charged. Thus, shipping and handling of a drone 10 containing shaped charges 62 or other explosive materials presents low risks where an uncharged capacitor is installed as the power supply 392. This is contrasted with shipping and handling of a drone 10 with a battery, which can be an inherently high risk activity and frequently requires a separate safety mechanism to prevent accidental detonation. Further, and as discussed previously, the act of charging a capacitor is very fast. Thus, the capacitor or supercapacitor being used as a power supply 392 for drone 10 can be charged immediately prior to deployment of the drone 10 into the wellbore 30.

While the option exists to ship the drone 10 preloaded with a rechargeable battery which has not been charged, i.e., the electrochemical potential of the rechargeable battery is zero, this option comes with some significant drawbacks. The goal must be kept in mind of assuring that no electrical charge is capable of inadvertently accessing any and all explosive materials in the drone 10. Electrochemical potential is often not a simple, convenient or failsafe thing to measure in a battery. It may be the case that the risk that a 'charged' battery may be mistaken for an 'uncharged' battery simply cannot be rendered sufficiently low to allow for shipping the drone 10 with an uncharged battery. In addition, as mentioned previously, the time for charging a rechargeable battery having adequate power for the drone 10 may be on the order of an hour or more. Currently, fast recharging batteries of sufficient charge capacity are uneconomical for the 'one-time-use' or 'several-time-use' that would be typical for batteries used in the drone 10.

In an embodiment, electrical components like the computer/processor 390, various sensors 145, coils 394, 396 and signal transceivers 386, 388 may be battery powered while explosive elements like the detonator for initiating detonation of the shaped charges 340 are capacitor powered. Such an arrangement would take advantage of the possibility that some or all of the computer/processor 390, sensors 145, coils 394, 396 and signal transceivers 386, 388 may benefit from a power supply having higher energy density, i.e., a battery, while initiating elements such as detonators typically benefit from a higher power density, i.e., capacitor/supercapacitor. A very important benefit for such an arrangement is that the battery is completely separate from the explosive materials, affording the potential to ship the drone 10 preloaded with a charged or uncharged battery. The power supply that is connected to the explosive materials, i.e., the capacitor/supercapacitor, via the detonator may be very quickly charged immediately prior to dropping drone 10 into wellbore 50.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of" Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A delivery system, comprising:

a magazine configured for receiving a plurality of drones; and a selector unit comprising:

a processor, a selector arm, and a selector arm window that defines a path for movement of the selector arm, wherein the processor is configured to activate the selector arm to select the drones from the magazine for placement in a wellbore.

2. The delivery system of claim 1, wherein the selector arm comprises:

a movable portion; and an engagement element for engaging a complimentarily configured securing portion of the drones.

3. The delivery system of claim 2, wherein the selector unit further comprises:

a driver configured to actuate the selector arm and move the movable portion toward and away from the magazine.

4. The delivery system of claim 3, wherein the driver is operable from a location remote from the selector unit.

5. The delivery system of claim 1, wherein:

the selector arm further comprises an electrical contact; and each of the drones include a complimentary electrical contact, wherein the selector arm and the drones are configured for electrical communication, via the electrical contact of the selector arm and the electrical contact of the drones, when the selector arm is engaged with one of the drones.

6. The delivery system of claim 1, wherein the magazine comprises a first chamber, a second chamber and an access port traversing the first and second chambers; and the plurality of drones comprises a first set of drones positioned in the first chamber and a second set of drones positioned in the second chamber, wherein the selector arm is moveable along the access port to engage and remove a selected drone from the first set of drones or the second set of drones.

7. The delivery system of claim 1, wherein the magazine is removably secured to a support structure positioned adjacent the selector unit.

8. A delivery system, comprising:

a mobile platform;

a magazine removably secured to the platform;

a plurality of drones positioned in the magazine; and a selector unit secured to the platform and comprising a processor, a selector arm, and a selector arm window extending around at least a portion of a body of the selector unit, the selector arm window defining a path for movement of the selector arm, wherein the processor is configured to activate the selector arm to select the drones from the magazine for placement in a wellbore.

9. The delivery system of claim 8, wherein the mobile platform comprises:

a plurality of platform rails to slidably receive and secure the magazine to the platform.

10. The delivery system of claim 8, wherein the mobile platform includes a flatbed of a semi-truck.

11. The delivery system of claim 8, wherein the selector arm comprises:

a movable portion; and an engagement element for engaging a complimentarily configured securing portion of the drones.

12. The delivery system of claim 11, wherein the selector unit further comprises:

a driver configured to actuate the selector arm and move the movable portion toward and away from the magazine.

13. The delivery system of claim 11, wherein:

the drone magazine comprises a first drone magazine and a second drone magazine; and the selector arm is configured to select the drones from the first magazine and the drones from the second magazine.

14. The delivery system of claim 13, wherein:

the selector arm further comprises an electrical contact; and each of the drones include a complimentary electrical contact, wherein the selector arm and the selected drone are configured for electrical communication, via the electrical contact of the selector arm and the electrical contact of the selected drone, when the selector arm is engaged with the selected drone.

15. A delivery system, comprising:

a first magazine comprising a chamber configured for receiving a first plurality of drones;

a second magazine comprising a chamber configured for receiving a second plurality of drones; and a selector unit comprising a processor, a selector arm, and a selector arm window that defines a path for movement of the selector arm between the first magazine and the second magazine, wherein the processor is configured for activating the selector arm, and the selector arm is configured for selecting a drone from at least one of the first plurality of drones and the second plurality of drones for placement in a wellbore.

16. The delivery system of claim 15, wherein the selector arm comprises:

a movable portion; and an engagement element for engaging a complimentarily configured securing portion of the drones, wherein the engagement element includes an electrical contact to facilitate electrical communication with the first and second plurality of drones.

17. The delivery system of claim 15, wherein the first magazine comprises sensors for detecting the presence of a drone in the chamber, and the second magazine comprises sensors for detecting the presence of a drone in the chamber.

* * * * *